US011660255B1

(12) United States Patent
Navarro

(10) Patent No.: US 11,660,255 B1
(45) Date of Patent: May 30, 2023

(54) LIQUID MEDICATION DISPENSER

(71) Applicant: Marco Navarro, Los Angeles, CA (US)

(72) Inventor: Marco Navarro, Los Angeles, CA (US)

( * ) Notice: Subject to any disclaimer, the term of this patent is extended or adjusted under 35 U.S.C. 154(b) by 102 days.

(21) Appl. No.: 17/132,266

(22) Filed: Dec. 23, 2020

Related U.S. Application Data

(60) Provisional application No. 62/953,024, filed on Dec. 23, 2019.

(51) Int. Cl.

| | |
|---|---|
| ***A61J 7/00*** | (2006.01) |
| ***A61J 1/05*** | (2006.01) |
| ***A61J 1/14*** | (2023.01) |

(52) U.S. Cl.
CPC ..... *A61J 7/0084* (2013.01); *A61J 1/05* (2013.01); *A61J 1/1412* (2013.01)

(58) Field of Classification Search
CPC ..... A61J 1/2089; A61J 1/2096; A61J 1/2058; A61J 1/201; A61J 1/2055; A61J 1/2062; A61J 7/0084; A61J 1/05; A61J 1/1412; A61M 5/14216; A61M 5/1452; A61M 39/223
See application file for complete search history.

(56) References Cited

U.S. PATENT DOCUMENTS

| | | | |
|---|---|---|---|
| 4,501,306 | A | 2/1985 | Chu et al. |
| 4,581,015 | A | 4/1986 | Alfano |
| 4,801,012 | A | 1/1989 | Steenhuisen et al. |
| 5,007,535 | A | 4/1991 | Meseke et al. |
| 5,099,992 | A | 3/1992 | Heimreid |
| 5,304,165 | A | 4/1994 | Haber et al. |
| 5,311,985 | A | 5/1994 | Suida |
| 5,329,976 | A | 7/1994 | Haber et al. |
| 5,423,791 | A | 6/1995 | Bartlett |
| 5,431,185 | A | 7/1995 | Shannon et al. |
| 5,454,805 | A | 10/1995 | Brony |

(Continued)

FOREIGN PATENT DOCUMENTS

| | | |
|---|---|---|
| WO | 2001049361 | 7/2001 |

OTHER PUBLICATIONS

"Multi Syringe Holder" found at https://capintec.com.

*Primary Examiner* — Vishal Pancholi
*Assistant Examiner* — Robert K Nichols, II
(74) *Attorney, Agent, or Firm* — The Patent Professor; John Rizvi, P.A.

(57) ABSTRACT

A liquid medication dispenser is provided having a dispenser housing with a housing interior. A plurality of syringe openings may be provided in the dispenser housing. A housing lid may be carried by the dispenser housing. A plurality of medication container seats may be provided in the housing lid. A plurality of medication dispensing openings may be provided in the plurality of medication container seats, respectively. A face plate may be carried by the dispenser housing. A plurality of syringe barrel cavities may be provided in the face plate and disposed in aligned or registering relationship with respect to the plurality of syringe openings, respectively. The syringe barrel cavities may have different sizes. A plurality of medication distribution assemblies may establish fluid communication between the plurality of medication dispensing openings, respectively, and the plurality of syringe openings, respectively.

15 Claims, 19 Drawing Sheets

(56) References Cited

U.S. PATENT DOCUMENTS

| | | | | |
|---|---|---|---|---|
| 5,894,870 | A | 4/1999 | Maxwell | |
| 5,911,252 | A | 6/1999 | Cassel | |
| 6,238,372 | B1 | 5/2001 | Zinger et al. | |
| 6,540,072 | B1 | 4/2003 | Fischer | |
| 6,755,220 | B2 | 6/2004 | Castellano et al. | |
| 6,783,003 | B2 | 8/2004 | Simm et al. | |
| 6,955,259 | B1 | 10/2005 | Jesse | |
| 7,192,423 | B2 | 3/2007 | Wong | |
| 7,611,012 | B2 | 11/2009 | Ross | |
| 8,016,003 | B2 | 9/2011 | Bullen | |
| 8,177,768 | B2 | 5/2012 | Leinsing | |
| 8,210,166 | B2 | 7/2012 | Denton et al. | |
| 8,360,114 | B2 * | 1/2013 | Clark | A61J 1/2096 141/330 |
| 8,485,357 | B2 | 7/2013 | Song et al. | |
| 8,608,723 | B2 | 12/2013 | Lev et al. | |
| 8,827,075 | B2 | 9/2014 | Seiwell | |
| 9,132,228 | B2 | 9/2015 | Yan | |
| 9,138,379 | B2 | 9/2015 | Beiriger | |
| 9,393,177 | B2 | 7/2016 | Davidian et al. | |
| D763,433 | S | 8/2016 | Davidian et al. | |
| 9,636,277 | B2 | 5/2017 | Foshee et al. | |
| 9,783,326 | B2 | 10/2017 | Py et al. | |
| 9,937,288 | B2 | 4/2018 | Wright et al. | |
| 9,981,082 | B2 | 5/2018 | Fish et al. | |
| 10,258,736 | B2 | 4/2019 | Metzmaker et al. | |
| 2005/0087256 | A1 | 4/2005 | Clark | |
| 2007/0151984 | A1 * | 7/2007 | Baker | A61J 1/2089 222/129 |
| 2009/0099543 | A1 | 4/2009 | Stein | |
| 2009/0306621 | A1 | 12/2009 | Thome, Jr. et al. | |
| 2012/0000569 | A1 | 1/2012 | Wiegel | |
| 2012/0056920 | A1 | 3/2012 | Russo et al. | |
| 2015/0238686 | A1 | 8/2015 | Mohyi | |
| 2015/0342828 | A1 * | 12/2015 | Bertoni | A61J 1/2058 141/7 |
| 2016/0136051 | A1 | 5/2016 | Lavi | |
| 2018/0369485 | A1 | 12/2018 | Yalisove | |

* cited by examiner

LIQUID MEDICATION DISPENSER

CROSS-REFERENCE TO RELATED APPLICATIONS

This application claims the benefit of U.S. Provisional Patent Application No. 62/953,024, filed on Dec. 23, 2019, which is incorporated by reference herein in its entirety.

FIELD OF THE INVENTION

The present invention relates generally to medication, and more particularly, to a liquid medication dispenser which is suitable to expeditiously dispense or load liquid medication from multiple medication containers into syringes of different sizes.

BACKGROUND OF THE INVENTION

In the medical field, various devices have been designed to transfer precisely measured quantities of liquid medications from a container and administer the medications to a patient. For example, the transfer and administration of medications is often carried out using syringes. A syringe is typically filled with the liquid medication by inserting a syringe needle or a syringe tip into the container in which the medication is stored, and then withdrawing the plunger of the syringe to draw the medication through the needle or tip into the barrel. The medication loaded into the syringe may then be injected into the patient. The use of syringes facilitates precise control in the quantity or volume of medication which is administered to a patient. Syringes may also enable medical personnel to administer a mixture of medications into a patient in a single administration.

Under circumstances in which multiple medications are to be repeatedly administered to a patient throughout a day or other time period, drawing the correct quantity of each medication for each administration may be laborious and time-consuming. Much care must be undertaken to insert the syringe needle or syringe tip into the container from which the medication is to be drawn, extend the plunger of the syringe the correct distance from the syringe barrel and withdraw the syringe needle or syringe tip from the container after the medication has been drawn into the syringe barrel. Repeated execution of the syringe filling and injection procedure may result in inaccuracies and inconsistencies in the administration of the optimum quantity of each medication over time.

A gastrostomy tube (G-tube) is a device which is inserted into the abdomen of a patient to administer nutrition directly to the stomach of the patient. The conventional method of loading the nutritious medium into a G-tube for subsequent administration to the patient is by opening a container which contains the medium, tilting the container and drawing the medium from the container using a syringe. The G-tube is then used to administer the medium from the syringe to the patient.

The conventional method of loading a nutrient medium into a syringe and then administering the medium to the patient from the syringe via the G-tube is laborious and time-consuming, particularly for patients who have special needs or frequently take multiple liquid medications on a daily basis.

Accordingly, there is an established need for a solution to at least one of the aforementioned problems. For example, there is a need for a device, equipment or system which facilitates dispensing or loading liquid medication from multiple medication containers into multiple syringes.

SUMMARY OF THE INVENTION

The present invention is directed to a liquid medication dispenser which is suitable for dispensing or loading liquid medication into multiple syringes.

In a first implementation of the invention, a liquid medication dispenser, suitable for loading liquid medication from a plurality of medication containers into different syringes, may include a dispenser housing having a housing interior. A plurality of medication dispensing openings may be formed through the dispenser housing. A plurality of sets of syringe openings may be formed through the dispenser housing, each set of syringe openings comprising two or more different-sized syringe openings. The liquid medication dispenser may further include a plurality of medication distribution assemblies, which may be arranged in the housing interior. Each medication distribution assembly may provide fluid communication between a respective medication dispensing opening of the plurality of medication dispensing openings and a respective set of syringe openings of the plurality of sets of syringe openings.

In a second aspect, the dispenser housing may further include a plurality of medication container seats in the housing. Each medication container seat may be configured to receive a respective medication container. A respective medication dispensing opening of the plurality of medication dispensing openings may be located at each medication container seat.

In another aspect, each medication container seat may be recessed into an outer surface of the dispenser housing.

In another aspect, the medication dispensing openings are formed through a top wall of the dispenser housing.

In another aspect, the top wall of the dispenser housing may be movable between a closed position enclosing the housing interior and an open position allowing access to the housing interior.

In yet another aspect, the liquid medication dispenser may further include a cover assembly mountable on the dispenser housing. The cover assembly may comprise a cover assembly frame defining a cover assembly interior. The cover assembly interior may be configured to house a plurality of medication containers in an upright position with each medication container of the plurality of medication containers arranged over a respective medication dispensing opening of the plurality of medication dispensing openings.

In another aspect, the cover assembly may include at least one storage compartment.

In another aspect, the cover assembly may include a plurality of container receptacles arranged in the cover assembly interior. Each container receptacle may be configured to contain a respective medication container in an upright position, and may be arranged in vertical alignment with a respective medication dispensing opening of the plurality of medication dispensing openings when the cover assembly is mounted on the dispenser housing.

In another aspect, the cover assembly may include a partition arranged in the cover assembly interior. The partition may comprise a plurality of partition openings formed through the partition and configured to receive a top opening of a respective medication container of a plurality of medication containers housed in the cover assembly interior. The liquid medication dispenser may further include a movable body insertable into and movable along a first area of the cover assembly interior. The movable body may include a plate having a plurality of plate openings configured to align with the plurality of partition openings. The plate may further comprise a plurality of container cap receivers, each container cap receiver arranged at a respective plate opening of the plurality of plate openings and configured to carry a respective container cap and prevent a transverse movement of the respective container cap relative to the respective plate opening. The movable body may be selectively movable between a first position and a second position. In the first position, the plate of the movable body may be arranged within the cover assembly interior and each plate opening of the plurality of plate openings may be adjacent to and aligned with a respective partition opening of the plurality of partition openings. In the second position, the plate of the movable body may be moved away from the plurality of partition openings allowing access to the partition openings.

In yet another aspect, the cover assembly may include a plurality of container receptacles arranged in the cover assembly interior and beneath the partition. Each container receptacle may be configured to contain a respective medication container in an upright position, and may be arranged in vertical alignment with a respective medication dispensing opening of the plurality of medication dispensing openings when the cover assembly is mounted on the dispenser housing. Each partition opening may face a respective container receptacle of the plurality of container receptacles.

In another aspect, the movable body may include a handle extending from the plate.

In another aspect, the cover assembly may include at least one storage compartment in a second area of the cover assembly interior separated from the first area.

In another aspect, a front wall of the dispenser housing may include a plurality of sets of through openings, each set of through openings comprising two or more through openings. The dispenser housing may further include a face plate mountable on the front wall of the dispenser housing, the face plate comprising a plurality of sets of syringe barrel cavities, each set of syringe barrel cavities comprising two or more syringe barrel cavities. Each syringe barrel cavity of the two or more syringe barrel cavities may be aligned with a respective through opening of the two or more through openings, such that each syringe barrel cavity and respective through opening form a respective syringe opening of the two or more syringe openings.

In yet another aspect, the face plate may be detachably mountable on the front wall. The two or more syringe barrel cavities may be sized differently to each other.

In another aspect, each medication distribution assembly of the plurality of medication distribution assemblies may include an inlet conduit and two or more outlet conduits. The inlet conduit may extend from the respective medication dispensing opening. Each outlet conduit of the two or more outlet conduits may extend from the inlet conduit to a respective syringe opening of the respective set of syringe openings.

In another aspect, the two or more syringe openings of the respective set of syringe openings may be arranged in vertical alignment. The two or more outlet conduits of each medication distribution assembly may also be arranged in vertical alignment.

In another aspect, the two or more syringe openings of the respective set of syringe openings may be arranged in spaced-apart relationship. The two or more outlet conduits of each medication distribution assembly may also be arranged in spaced-apart relationship.

In yet another aspect, the plurality of sets of syringe openings may be formed through a front wall of the dispenser housing, and the two or more outlet conduits of each medication distribution assembly may be arranged in a front-to-back direction of the dispenser housing.

In another implementation, the dispenser housing may have a bottom wall and a front wall, a rear wall and a pair of side walls extending from the bottom wall. The dispenser housing may have a housing interior and a housing lid which closes the housing interior. A plurality of medication container seats may be provided in the housing lid. A plurality of medication dispensing openings may extend through the housing lid at the medication container seats, respectively. The medication container seats may be sized and configured to accommodate a plurality of medication containers, respectively, each of which contains a supply of liquid medication. A container opening may extend through the bottom of each medication container in registration with each corresponding medication dispensing opening.

A plurality of syringe openings may be provided in the front wall of the dispenser housing. A face plate may be deployable over the front wall of the dispenser housing. The face plate may include a plurality of syringe barrel cavities that may have various sizes. The syringe barrel cavities may align or register with the respective syringe openings in the dispenser housing. Accordingly, the syringe barrel cavities in the face plate may be sized and configured to accommodate the syringe barrels of respective syringes having different sizes as the tips of the syringes extend through the syringe openings in the front wall of the dispenser housing.

A plurality of medication distribution assemblies may be disposed in the housing interior of the dispenser housing. The medication distribution assemblies may establish fluid communication between the medication dispensing openings in the respective medication container seats in the housing lid and the respective syringe openings in the front wall of the dispenser housing. Each medication distribution assembly may include an inlet conduit which extends from each corresponding medication container seat and at least one outlet conduit which extends from the inlet conduit and terminates in fluid communication with the corresponding syringe opening in the front wall of the dispenser housing.

In an illustrative application of the liquid medication dispenser, liquid medication is placed in each medication container. Each medication container is then placed in a corresponding medication container seat in the housing lid with the container opening in each medication container disposed in sealing engagement with the inlet conduit of the corresponding medication distribution assembly through the corresponding medication dispensing opening. The tip of a syringe which is to be filled with medication is inserted first through the syringe barrel cavity which corresponds to the size of the barrel of the syringe and then through the registering syringe opening into the outlet conduit of the corresponding medication distribution assembly, respectively. The barrel of the syringe is then seated in the syringe barrel cavity as the plunger of the syringe is extended to draw medication from the medication container through the medication distribution assembly into the barrel of the syringe, respectively. The syringe barrel of the syringe is then withdrawn from the syringe barrel cavity and used to inject the liquid medication into a patient typically in the conventional manner.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed toward a liquid medication dispenser which is suitable for dispensing or loading liquid medication from multiple medication containers into multiple syringes. The liquid medication dispenser can expedite and/or increase precision in loading liquid medication into multiple syringes, including syringes of different sizes.

Figure 1:
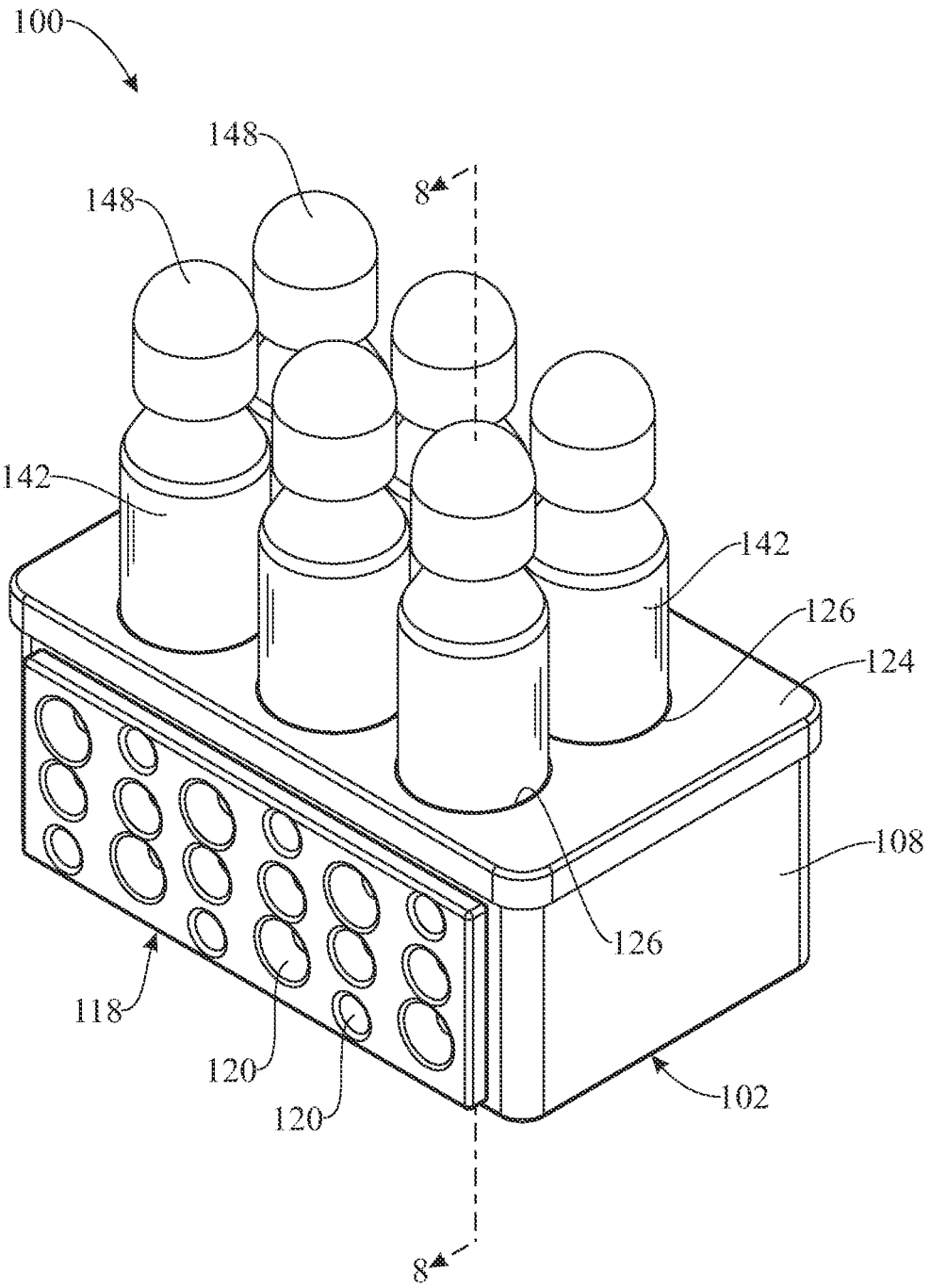
FIG. 1 presents a top front isometric view of a liquid medication dispenser in accordance with a first illustrative embodiment of the present invention, the liquid medication dispenser shown with six illustrative medication containers received in corresponding medication container seats of the liquid medication dispenser for dispensing liquid medication therefrom.
Figure 2:
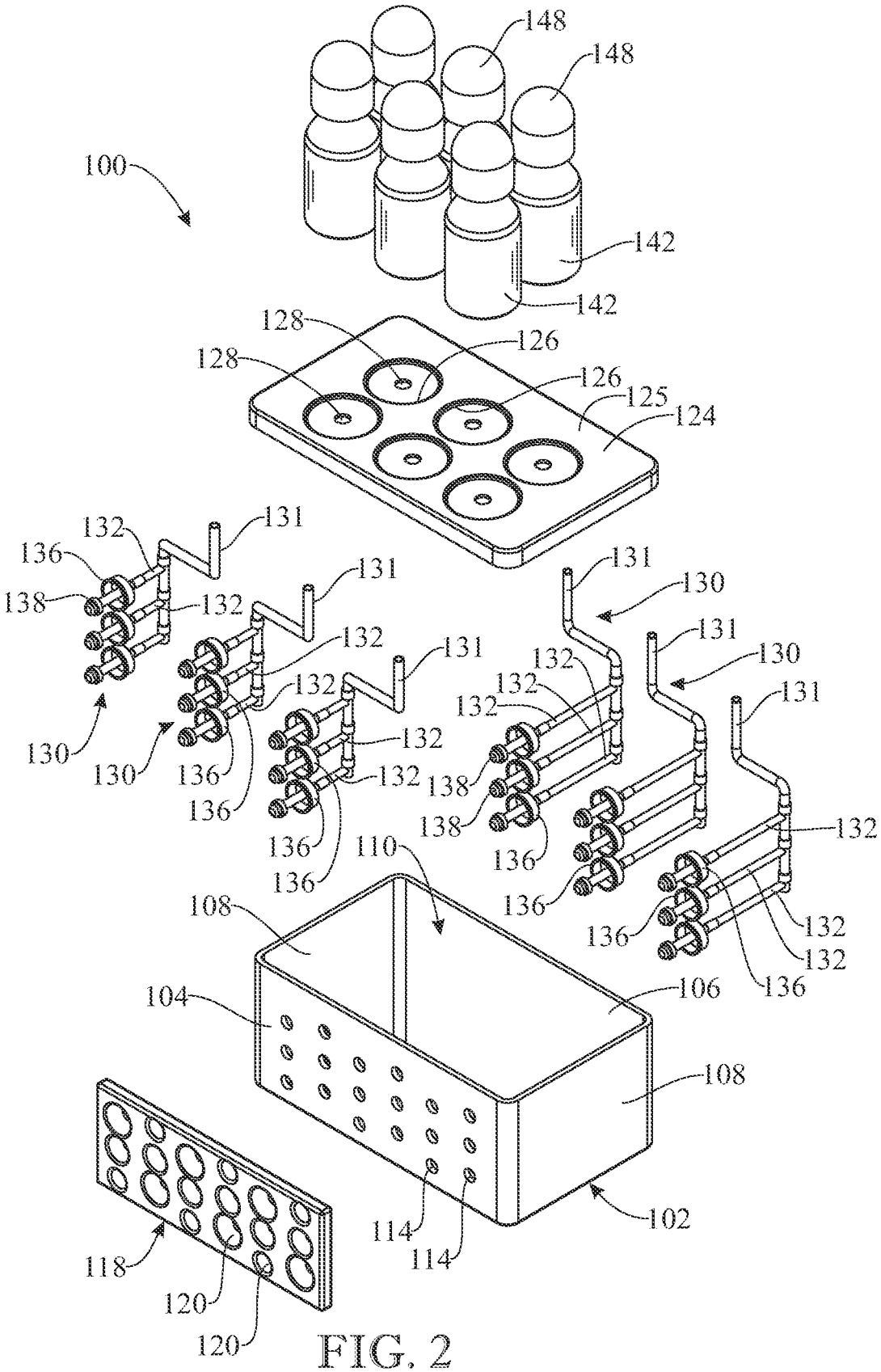
FIG. 2 presents an exploded, top front isometric view of the liquid medication dispenser of FIG. 1.
Figure 6:
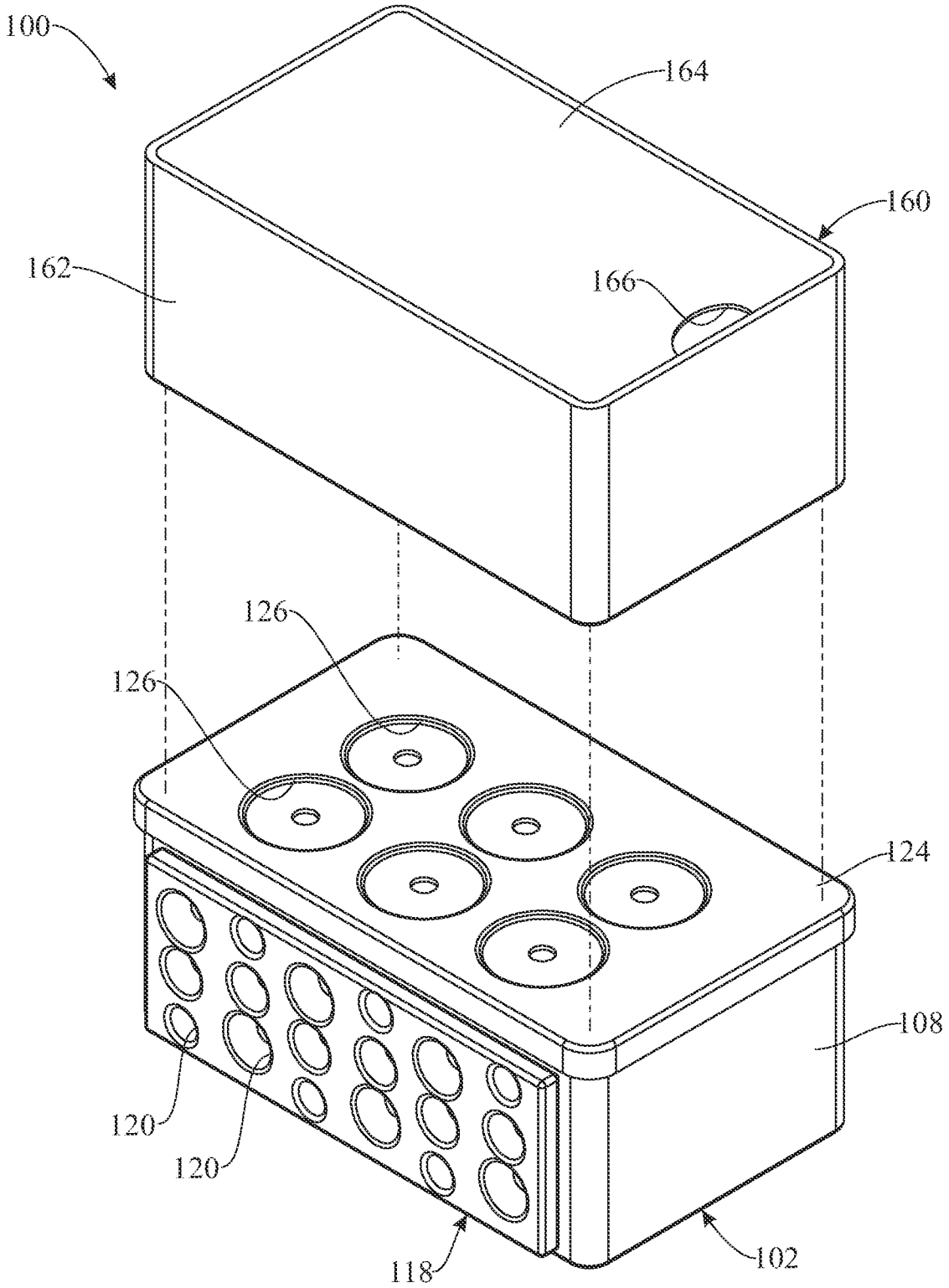
FIG. 6 presents an exploded top front isometric view illustrating deployment of a cover assembly on the dispenser housing of the liquid medication dispenser of FIG. 1.
Figure 7:
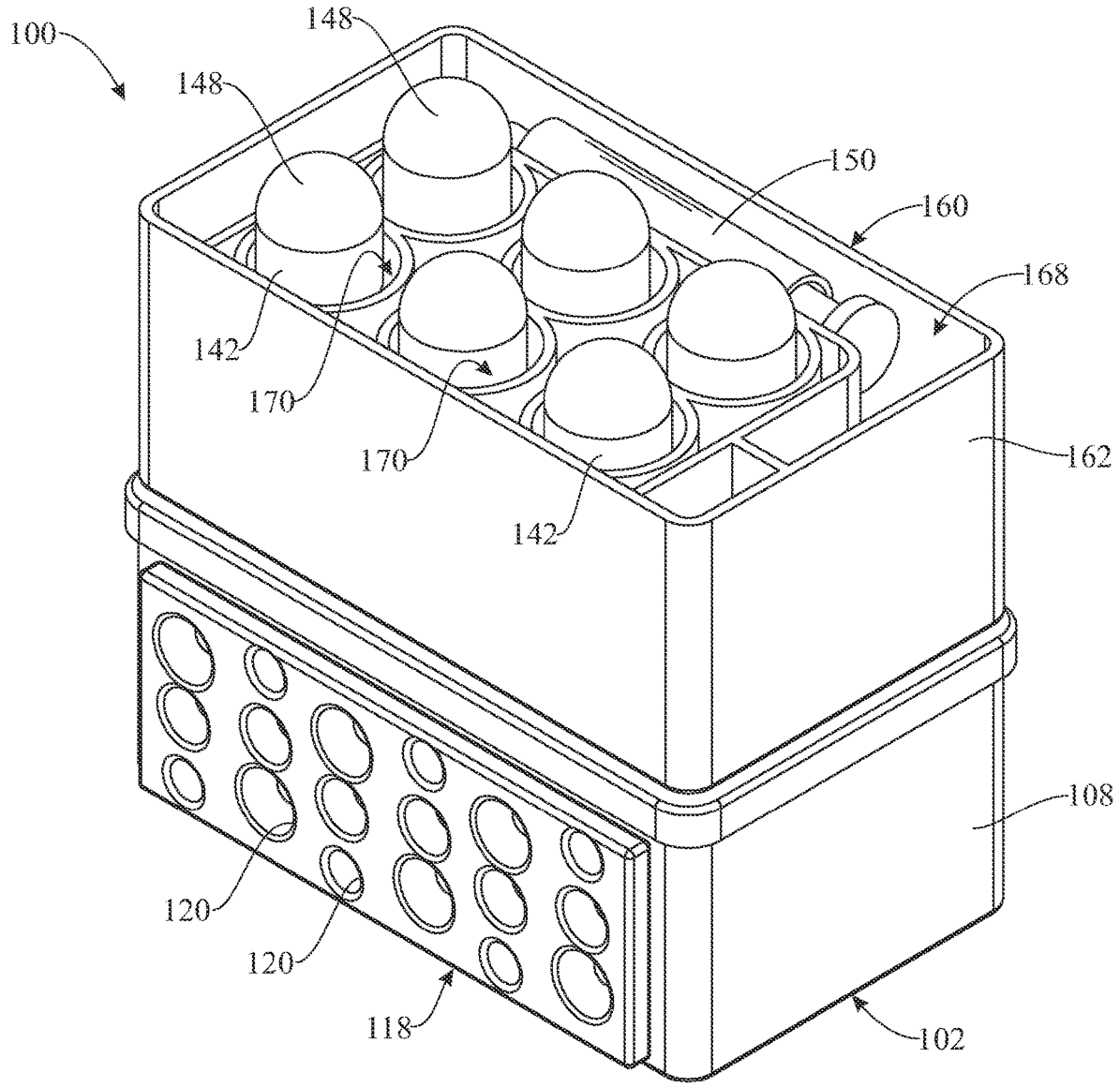
FIG. 7 presents a top front isometric view of the cover assembly of FIG. 6 deployed in place on the dispenser housing and the cover lid of the cover assembly removed.
Figure 8:
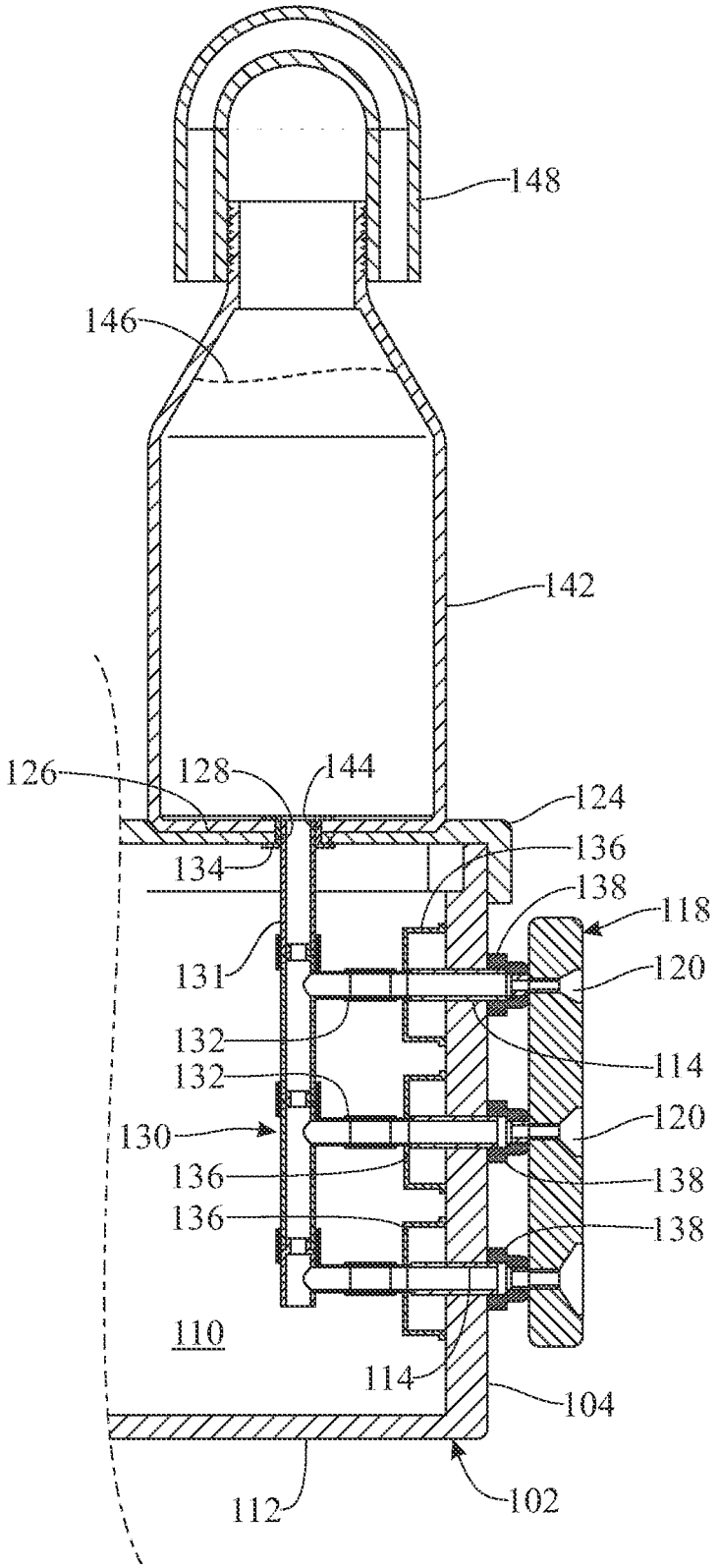
FIG. 8 presents a cross-sectional side elevation view, the cross section taken along section plane 8-8 indicated in FIG. 1, of a medication container disposed in fluid communication with a medication distribution assembly and a plurality of syringe barrel cavities in the face plate of the liquid medication dispenser of FIG. 1.
Figure 9:
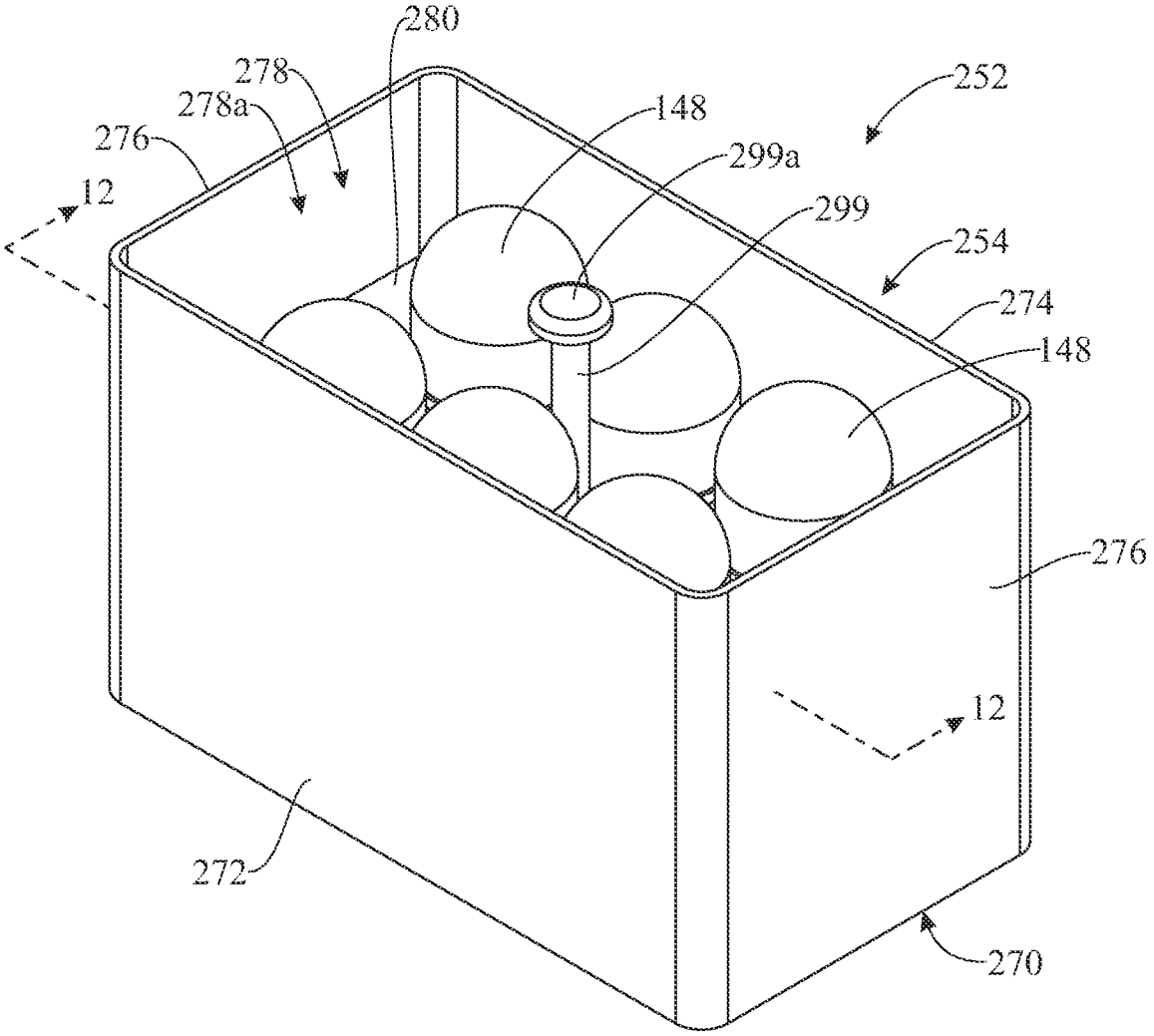
FIG. 9 presents a top front isometric view of cover assembly of a liquid medication dispenser in accordance with a second illustrative embodiment of the present invention, the cover assembly comprising a movable body carrying a plurality of container caps.

Referring to FIGS. 1-8 of the drawings, a first illustrative embodiment of the liquid medication dispenser is generally indicated by reference numeral 100. With reference initially to FIGS. 1 and 2, the liquid medication dispenser 100 may include a dispenser hollow body or housing 102. As illustrated in FIGS. 2 and 8, in some embodiments, the dispenser housing 102 may be generally elongated and rectangular with a floor or bottom wall 112 (FIG. 8). A front wall 104 and a rear wall 106 may extend from the bottom wall 112. A pair of side walls 108 may extend from the bottom wall 112 between the front wall 104 and the rear wall 106. A housing interior 110 may be defined by and between the bottom wall 112, the front wall 104, the rear wall 106 and the side walls 108 of the dispenser housing 102. As further illustrated in FIG. 2, a plurality of syringe openings 114 may extend through the dispenser housing 102, and more preferably, through at least one of the front wall 104, the rear wall 106 and the side walls 108, with the bottom wall 112 configured instead to rest on a surface such as a countertop or tabletop. In some embodiments, one or more of the syringe openings 114 may be threaded. For example, in the present embodiment, the plurality of syringe openings 114 is provided in the front wall 104. The syringe openings 114 can be provided in a selected pattern and spacing for purposes which will be hereinafter described.

With continued reference to FIGS. 1 and 2, the dispenser housing 102 may include a face plate 118 provided over the front wall 104. In some embodiments, the face plate 118 may be detachably attached to the front wall 104 of the dispenser housing 102, such as by magnetic fasteners, snap fasteners, threaded fasteners, hook-and-loop fasteners, detachable or repositionable adhesive materials, friction fitting, or other fastening mechanisms. A plurality of sets of syringe barrel cavities 120 may be provided in the face plate 118, and may extend through the face plate 118, as shown in FIG. 8. The syringe barrel cavities 120 may align or register with the respective syringe openings 114 in the front wall 104 of the dispenser housing 102. In some embodiments, one or more of the syringe barrel cavities 120 may be threaded. In some embodiments, such as the present embodiment, each set of syringe barrel cavities 120 may include syringe barrel cavities 120 of various sizes (e.g., small, medium and large) to accommodate the syringe barrels 154 of syringes 150 having respective diameters, as will be hereinafter further described.

The face plate 118 being disconnectable allows, for instance, for customization of the liquid medication dispenser 100. For example, more than one face plate 118 can be included and may be interchangeably connectable to the front wall 103, with the different-sized barrel cavities arranged in a different configuration (relative size, relative position, and number of cavities of each specific size) in each face plate 118 relative to the other. By interchanging the face plates 118, the user may configure the different-sized syringe barrel cavities 120 of the liquid medication dispenser. For example, the user may choose to mount a face plate 118 having only small- and medium-sized syringe barrel cavities 120. In other applications, a face plate 118 having large-, medium- and small-sized syringe barrel cavities 120 may be mounted instead.

A housing lid 124 may be provided on the dispenser housing 102 to close the housing interior 110. In some embodiments, the housing lid 124 may be removable from the dispenser housing 102. A plurality of medication container seats 126 may be provided in the housing lid 124; for instance, in the present embodiment, the medication container seats 126 are recessed into a top side 125 of the housing lid 124. A plurality of medication dispensing openings 128 may extend through the housing lid 124 at the respective medication container seats 126. The medication container seats 126 may be sized and configured to accommodate a plurality of medication containers 142, respectively, each of which contains a supply of liquid medication 146 (FIG. 8) and may have a detachable container cap 148. As illustrated in FIG. 8, a container opening 144 may extend through the bottom of each medication container 142. The container opening 144 may align or register with each corresponding medication dispensing opening 128 when the medication container 142 is seated in the corresponding medication container seat 126.

Figure 3:
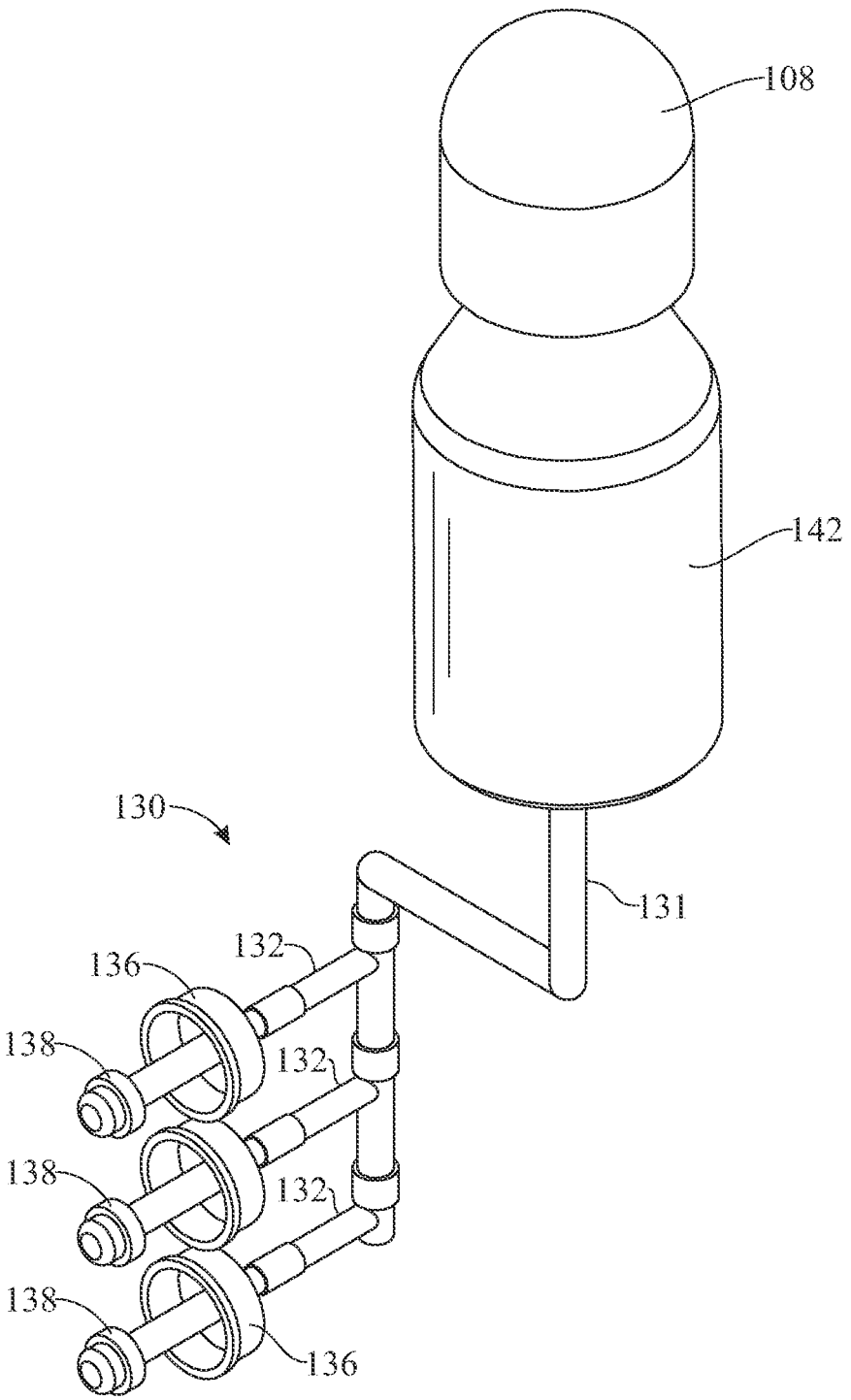
FIG. 3 presents a top front isometric view showing a medication distribution assembly with a medication container disposed in fluid communication therewith.
Figure 4:
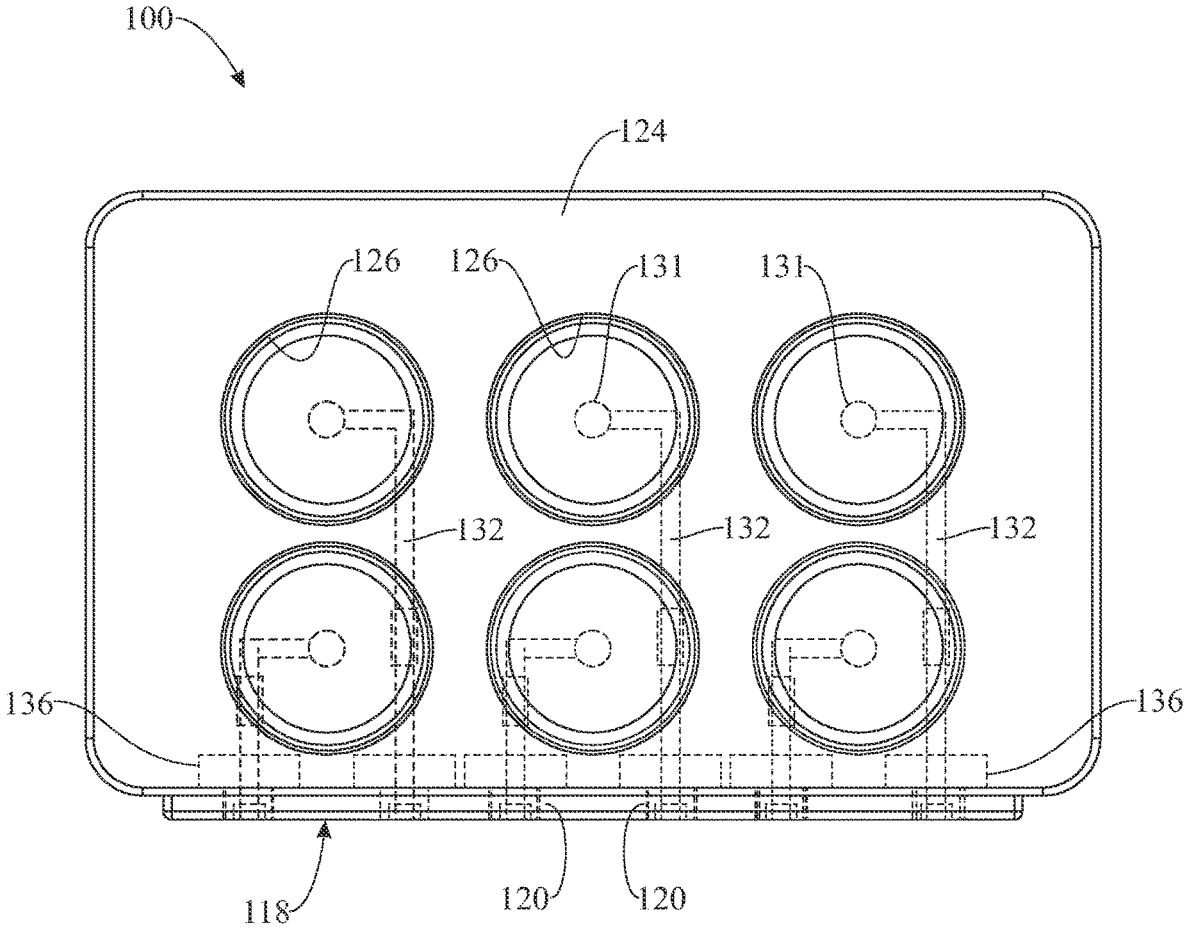
FIG. 4 presents a top plan view of the liquid medication dispenser of FIG. 1.

As particularly illustrated in FIGS. 2, 3 and 8, a plurality of medication distribution assemblies 130 may be disposed in the housing interior 110 of the dispenser housing 102. The medication distribution assemblies 130 which include fluid conduits and are configured to establish fluid communication between the medication dispensing openings 128 in the respective medication container seats 126 of the housing lid 124 and the respective syringe openings 114 in the front wall 104 of the dispenser housing 102. For instance, in the present embodiment, each medication distribution assembly 130 is configured to facilitate flow of liquid medication 146 from each medication container 142 to a corresponding set of syringe openings 114 in the front wall 104 of the dispenser housing 102, and to a corresponding set of small, medium and large syringe barrel cavities 120 in the face plate 118. As best shown in FIG. 2, each medication distribution assembly 130 may include a vacuum fitting with an inlet conduit 131 which extends from each corresponding medication container seat 126 in, for instance, a vertically downward direction as shown. As illustrated in FIG. 8, a resilient seal 134 made of rubber, plastic or other elastic material may impart a fluid-tight seal between each inlet conduit 131 and the corresponding medication dispensing opening 128 in the housing lid 124. While the seal 134 of the present embodiment extends through both the container opening 144 of the medication container 142 and the medication dispensing opening 128 in the housing lid 124, alternative embodiments are contemplated; for example, the seal 134 may comprise a first seal and a second seal, wherein the first seal extends about the container opening 144 and second seal extends about the medication dispensing opening 128. Furthermore, while the inlet conduit 131 is shown extending through both the medication dispensing opening 128 and container opening 144, alternative embodiments are contemplated such as, but not limited to, the inlet conduit 131 extending into the medication dispensing opening 128 but not into the container opening 144.

With continued reference to FIGS. 2, 3 and 8, a plurality of outlet conduits 132 may extend from the inlet conduit 131, such as along a front-to-back direction of the dispenser housing 102 and frontward, towards the front wall 104 of the dispenser housing 102, as shown. The outlet conduit 132 may terminate in fluid communication with a corresponding syringe opening 114 in the front wall 104 of the dispenser housing 102. Accordingly, each set of different-sized syringe barrel cavities 120 in the face plate 118 may communicate with the respective outlet conduits 132 of the medication distribution assembly 130 through the respective syringe openings 114 in the front wall 104. As shown, each outlet conduit 132 may be disposed in perpendicular relationship to the inlet conduit 131 from which it extends. In some embodiments, such as the present embodiment, the plurality of outlet conduits 132 of each inlet conduit 131 may be arranged in vertical alignment, spaced apart from and parallel to each other. In some embodiments, the outlet conduits 132 may be horizontal, as shown; however, alternative embodiments are contemplated in which the outlet conduits 132 may be sloped downstream, towards the syringe openings 114. Similarly, the depicted inlet conduit 131 may comprise one or more horizontal portions, as shown; in some embodiments, said portion(s) may be sloped downstream, to favor fluid flow towards the syringe openings 114.

In some embodiments, a seal sleeve 136 may be provided on each outlet conduit 132 of each medication distribution assembly 130. As illustrated in FIG. 8, each seal sleeve 136 may surround the corresponding outlet conduit 132 and sealingly engage an interior surface of the front wall 104 such as to capture any potential liquids therewithin. A compress and seal fitting 138 may terminate each outlet conduit 132 exterior to the front wall 104. The compress and seal fitting 138 may engage an exterior surface of the front wall 104 for fluid sealing purposes.

In typical application of the liquid medication dispenser 100, one or more liquid medications 146 (FIG. 8) may be placed in a plurality of the medication containers 142. Each medication container 142 may contain a same or different type of liquid medication 146. Each medication container 142 may then be seated in a corresponding medication container seat 126 in the housing lid 124 of the dispenser housing 102. Accordingly, as illustrated in FIG. 8, the inlet conduit 131 of each medication distribution assembly 130 may be sealingly disposed in fluid communication with the medication container 142 through the corresponding medication dispensing opening 128 in the housing lid 124 and container opening 144 in the medication container 142.

Figure 5:
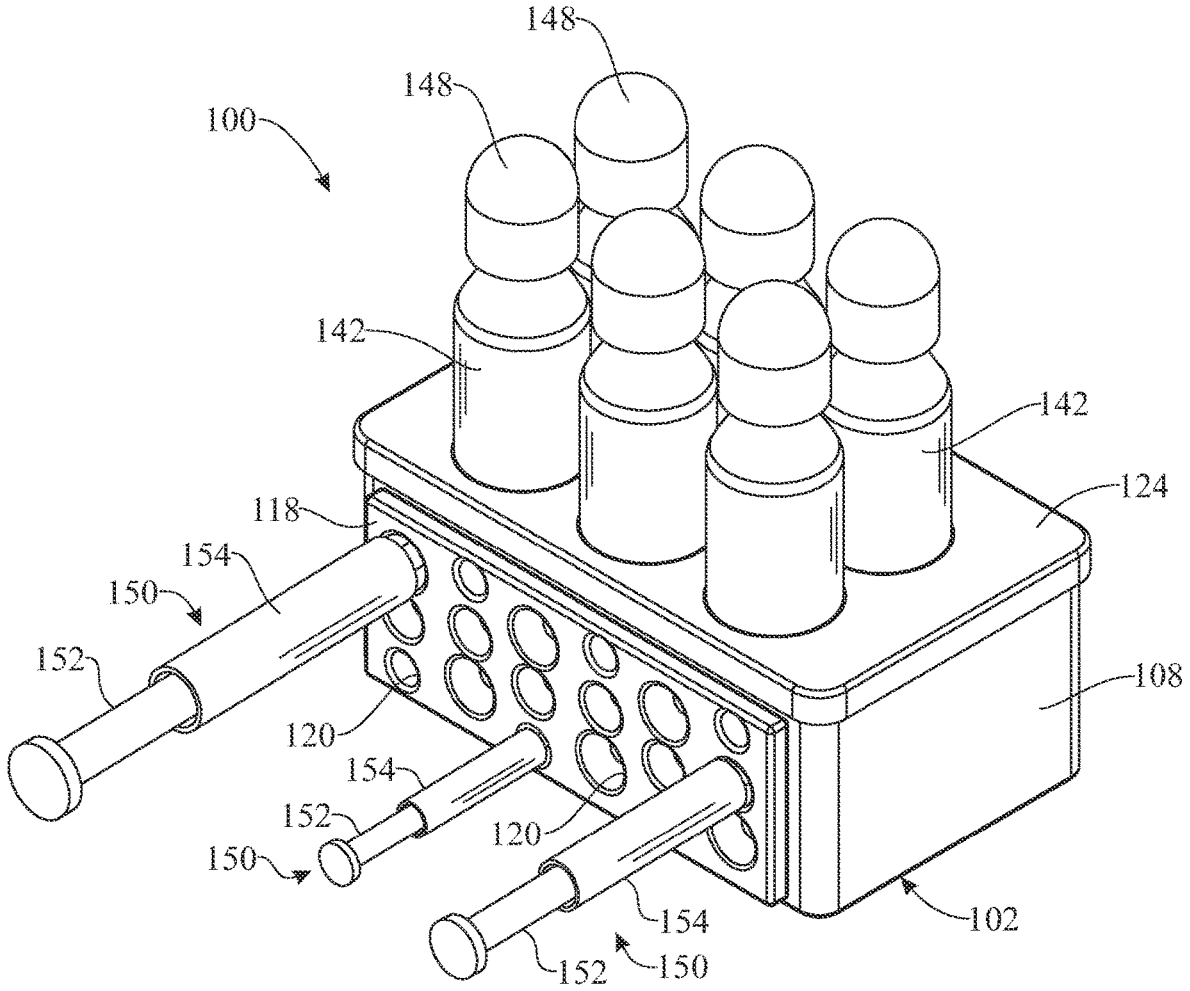
FIG. 5 presents a top front isometric view of the liquid medication dispenser of FIG. 1 in typical application thereof, for which several syringes are connected to the liquid medication dispenser.

As illustrated in FIG. 5, a syringe 150 may be selected for use in injecting a selected volume of a selected liquid medication 146 into a patient (not illustrated), for use in preparing a formulation or for other applicable uses. A syringe barrel cavity 120 which corresponds to the medication container 142 having the selected liquid medication 146 and corresponds to the diameter of the syringe barrel 154 of the syringe 150 may be identified among the available syringe barrel cavities 120 corresponding to the medication container seat 126 in which the medication container 142 having the selected liquid medication 146 is seated. The syringe 150 may be deployed in place by initially inserting the tip of the syringe barrel 154 through the selected syringe barrel cavity 120 of the face plate 118 and the corresponding registering syringe opening 114 in the front wall 104 and then into the outlet conduit 132 of the corresponding medication distribution assembly 130; alternatively, the syringe 150 may be deployed in place by inserting a syringe barrel tip through the selected syringe barrel cavity 120 of the face plate 118. The syringe plunger 152 may then be extended from the syringe barrel 154 of the syringe 150 to draw the liquid medication 146 from the medication container 142 through the container opening 144, medication dispensing opening 128 and inlet conduit 131 and outlet conduit 132, respectively, of the medication distribution assembly 130, and then through the syringe barrel tip into the syringe barrel 154. Once the syringe barrel 154 has been loaded with liquid medication 146, the syringe barrel 154 of the syringe 150 may be removed from the syringe barrel cavity 120 and the syringe 150 used to inject the liquid medication 146 into a patient (not illustrated) or for other applicable use. As shown, by having each medication distribution assembly 130 provide fluid communication from each medication dispensing opening 128 to a plurality of syringe barrel cavities 120 of different sizes, each medication container 142 may communicate with syringe barrel cavities 120 configured to accommodate syringes 150 having different volumes. Thus, the user can select which syringe barrel cavity 120, depending on the volume of the liquid medication 146 which is to be injected into the patient. In some embodiments, each outlet conduit 132 may include a respective one-way valve to prevent inward fluid flow from the corresponding syringe barrel cavity 120 when said corresponding syringe barrel cavity 120 is not in use. For instance, in the present embodiment, each elastic, compress and seal fitting 138 may sealingly close the end of the outlet conduit 132 facing the syringe barrel cavity 120 and be opened if a syringe barrel tip is inserted into and through the compress and seal fitting 138.

It will be appreciated by those skilled in the art that the liquid medication dispenser 100 may provide an alternative to conventional techniques for loading liquid medication into a syringe in order to feed the medication to a patient via a G-tube (gastrostomy tube). The liquid medication dispenser 100 may facilitate direct loading of the liquid medication into a syringe and direct administration of the liquid medication using a G-tube. This expediting may save considerable time and hassles for patients who have special needs or take liquid medication frequently. The liquid medication dispenser 100 enables a user to line up multiple medication containers 142 and draw out a selected quantity or volume of liquid medication which is needed using a universal syringe type. Each medication container 142 may be emptied from the bottom up, and the container cap 148 may be detached from the medication container 142 to facilitate refilling of the medication container 142. Accordingly, in applications in which a G-tube is used to administer the liquid medication 146 to a patient, different liquid medications 146 can be drawn out using whichever type of syringe 150 is being used instead of having to separately "tilt and draw" the liquid medication 146 from each medication container 142.

As illustrated in FIGS. 6 and 7, in some embodiments, the liquid medication dispenser 100 may further include a removable cover assembly 160 that may be deployed on the dispenser housing 102 to cover or conceal the medication container seats 126 in the housing lid 124 for transport and/or storage of the liquid medication dispenser 100. The cover assembly 160 may include a cover assembly frame 162. A cover assembly lid 164 may detachably engage the cover assembly frame 162. A finger notch 166 may be provided in the cover assembly lid 164 to facilitate selective removal or detachment of the cover assembly lid 164 from the cover assembly frame 162.

As illustrated in FIG. 7, where the cover assembly lid 164 has been removed from the cover assembly frame 162, at least one compartment 168, 170 may be provided in the cover assembly frame 162. In some embodiments, the at least one compartment 168, 170 may include at least one syringe compartment 168 which is sized and configured to contain at least one syringe 150. Alternatively or additionally, the at least one compartment 168, 170 may include at least one medication container compartment 170 sized and configured to contain at least one medication container 142. For example, in the present embodiment, each medication container compartment 170 is sized and configured to contain a respective medication container 142. Accordingly, when preparing to use the liquid medication dispenser 100, the cover assembly 160 can be removed from the dispenser housing 102 to reveal the mediation container seats 126, and the cover assembly lid 164 may be removed from the cover assembly frame 162 to access the syringe 150 and the medication containers 142 for use. The user may extract the needed medication container 142 and the syringe 150, and fit them respectively into a medication container seat 126 and the corresponding syringe barrel cavity 120. The liquid medication dispenser 100 may then be used as described heretofore to load the syringe 150.

In some embodiments, the cover assembly 160 may include an open bottom configured to allow the medication containers 142 to be fitted into the medication container seats 126 while the cover assembly 160 is mounted on the dispenser housing 102, allowing the liquid medication dispenser 100 to be used without removing the cover assembly 160 from the dispenser housing 102. When needed, each medication containers 142 may be removed from the corresponding medication container compartment 170 for refill, and may be easily fitted back into the corresponding medication container seat 126 as guided by the corresponding medication compartment 170. Alternatively, the open-bottom cover assembly 160 may be removed from the dispenser housing 102 prior to using the liquid medication dispenser 100, if needed or desired.

Turning to FIGS. 9-13, a cover assembly 252 in accordance with a second illustrative embodiment of the invention is shown. The cover assembly 252 may be used together with a dispenser housing 102 and medication dispensing mechanisms and elements carried by the dispenser housing 102 as described with reference to FIGS. 1-8, to easily and conveniently dispense medications from one or more medication containers 142 into one or more syringes 150.

Figure 10:
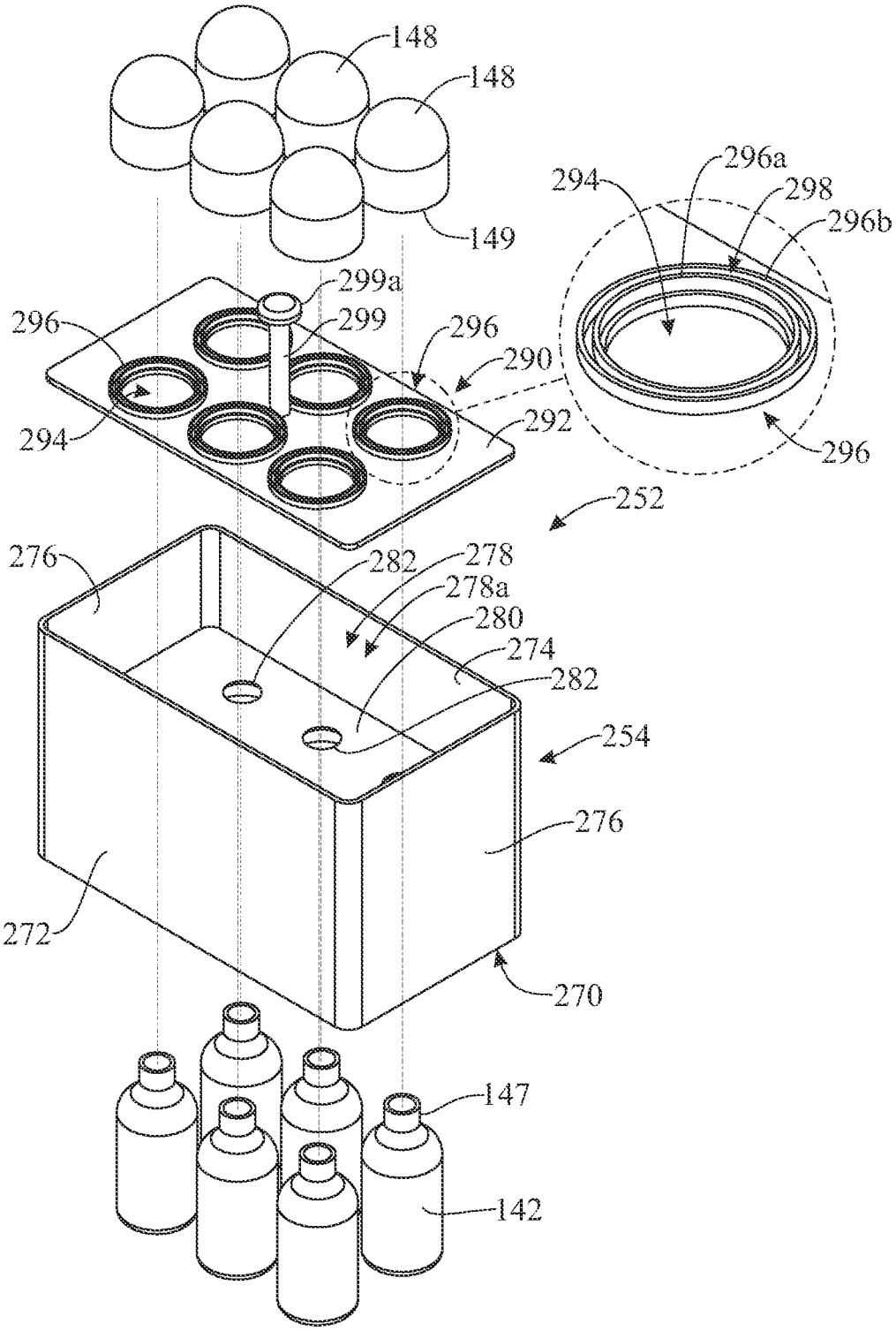
FIG. 10 presents an exploded, top front isometric view of the cover assembly and container caps of FIG. 9, together with a corresponding plurality of medication containers, the figure including an enlarged view of one of the container cap receivers comprised in the movable body.
Figure 11:
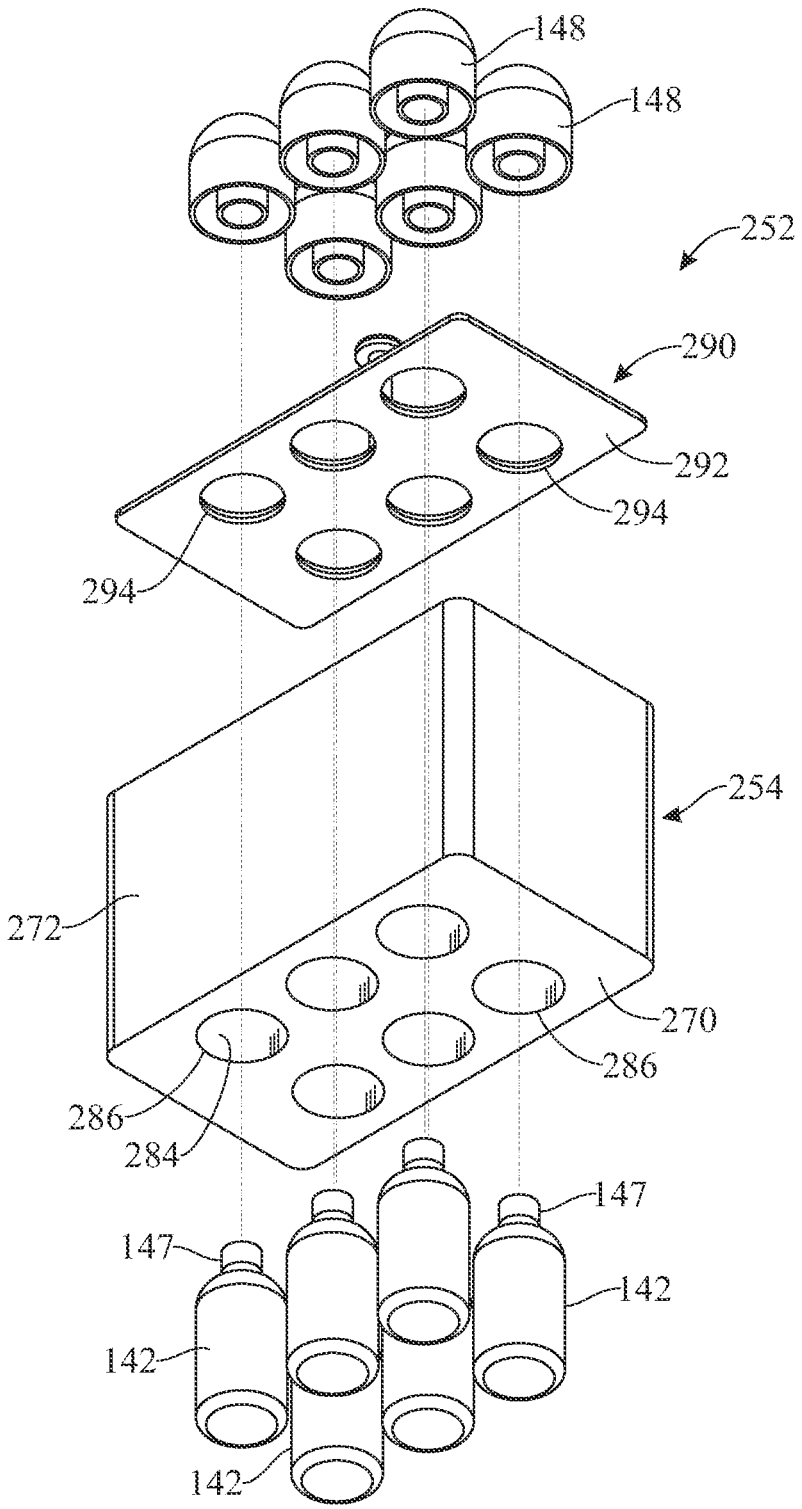
FIG. 11 presents an exploded, bottom front isometric view of the cover assembly, container caps and medication containers of FIG. 10.

Similarly to the previous embodiment, the cover assembly 252 comprises a cover assembly frame or cover housing 254 that may be generally elongated and rectangular and may include a bottom wall 270, best shown in FIG. 11. The cover housing 254 may include a front wall 272, a rear wall 274 and pair of side walls 276 extending from the bottom wall 270 and delimiting a cover assembly interior 278 (FIG. 10).

Figure 12:
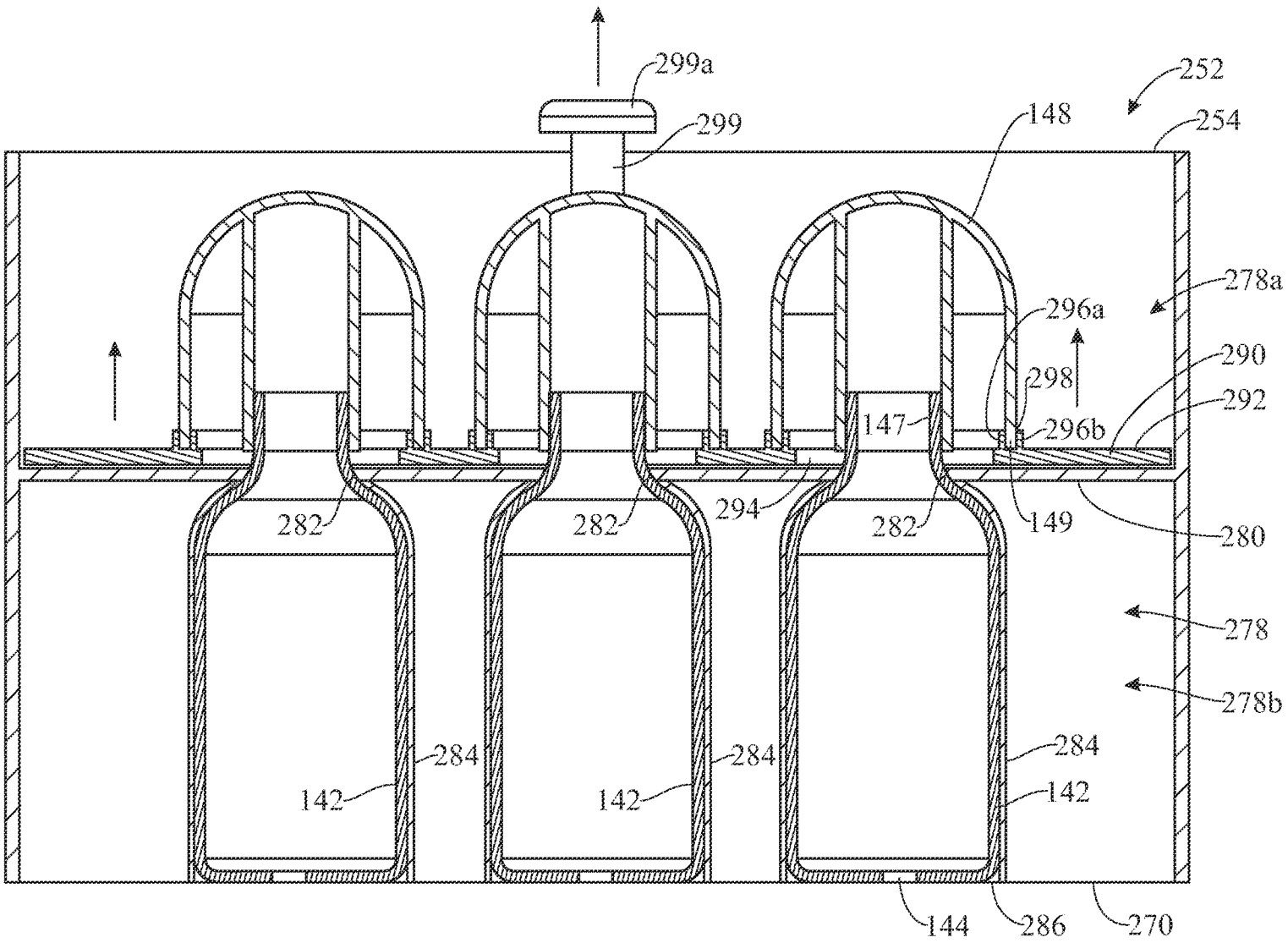
FIG. 12 presents a cross-sectional front elevation view of the cover assembly of FIG. 9, the cross section take along section plane 12-12 indicated in FIG. 9, with a movable body carrying the container caps shown in a lowered position relative to the cover assembly frame and the medication containers.

As best shown in FIGS. 10 and 12, the cover housing 254 further includes an inner wall or partition 280 arranged in an intermediate or central area of the cover assembly interior 278 and preferably horizontally arranged, as best shown in FIG. 12. The partition 280 divides the cover assembly interior 278 into a top interior compartment 278*a* and a bottom interior compartment 278*b* and includes openings 282 extending through the partition 280 and communicating the top and bottom interior compartments 278*a* and 278*b*. With continued reference to FIG. 12, the cover housing 254 further includes a plurality of container receptacles 284, arranged within the bottom interior compartment 278*b* of the cover assembly interior 278. Each container receptacle 284 extends between the bottom wall 270 and the partition 280, and ends, and bottom and top ends thereof, in a bottom opening 286 formed in the bottom wall 270 and in a corresponding opening 282 of the partition 280. Each container receptacle 284 is configured to receive a respective one of the medication containers 142 through the bottom opening 286 such that a neck 147 of the medication container 142 extends through the opening 282 of the partition 280 and into the top interior compartment 278*a* for purposes that will be described hereinafter.

The cover assembly 252 of the present embodiment further includes a movable support or body 290 movably received within the cover assembly interior 278. The movable body 290 is movable by a user and is configured to carry the container caps 148 such that user operation or maneuvering of the movable body 290 allows all container caps 148 to be jointly and easily separated from, or reattached to, the respective medication containers 142. The movable body 290 may include a base or plate 292, which may be rectangular in some embodiments. A plurality of openings 294 are formed through the plate 292, wherein each opening 294 is configured to align with a respective opening 282 of the partition 280, to enable the corresponding bottle neck 147 to also extend through the opening 294 when the movable body 290 is in a lowered position, as will be described hereinafter. The plate 292 further includes a plurality of container cap receivers 296. The container cap receivers 296 are configured to receive the container caps 148, i.e. to allow the connection or engagement thereto of the container caps 148. In preferred embodiments of the invention, when receiving the container caps 148, the container cap receivers 296 sufficiently prevent movement of the container caps 148 relative to the plate 292 so that user operation of the movable body 290 to move the movable body 290 is unable to cause a transverse or vertical movement of the container caps 148 relative to the plate 292; i.e., the container cap receivers 296 are preferably such that the container caps 148 remain connected thereto and carried thereby while the movable body 290 is moved by the user. Furthermore, the container cap receivers 296 are configured to allow the container caps 148 to be connected to and disconnected from the container cap receivers 296 by adequately manipulating each container cap 148 relative to the corresponding container cap receiver 296. For instance and without limitation, the container cap receivers 296 may take the form of a male or female thread which is threadably connected to a corresponding threaded portion formed in the container caps 148. In another example, the container cap receivers 296 may frictionally retain, clamp, clip, snap-fit or otherwise retain the container caps 148 thereto; for instance, in the present embodiment, each container cap receiver 296 comprises two concentric circular ridges 296*a*, 296*b* protruding outwardly (upwardly) from the plate 292 and delimiting a gap 298 therebetween, wherein the gap 298 is shaped and sized to snugly receive a bottom edge 149 of the corresponding container cap 148. In some embodiments, as shown, the ridges 296*a*, 296*b* may extend continuously or in a fully circular shape, and the gap 298 may be annular; however, alternative embodiments are contemplated in which one or both of the ridges 296*a*, 296*b* may be formed as discrete portions and yet be able to retain the bottom edge 149 of the container cap 148 therebetween.

The movable body 290 further includes a handle 299 extending upward from the plate 292 such that a user can grasp the handle 299 to raise or lower the movable body 290. In some embodiments, as shown, the handle 299 may be shaped as a vertical rod or post, optionally provided with a wider end portion or head 299*a* to facilitate manually exerting an upward or downward force on the handle 299; however, alternative embodiments are contemplated, such as but not limited an L-shaped, T-shaped, or O-shaped protrusion, or other ergonomic protrusion or feature, to facilitate lifting and lowering the movable body 290, without departing from the scope of the present disclosure.

Operation of the cover assembly 252 will now be described with reference to FIGS. 12 and 13. With reference initially to FIG. 12, firstly, the container caps 148 may be removed from medication containers 142. The medication containers 142 may then be inserted through the bottom openings 286 and into the corresponding container receptacles 284 formed in the bottom interior compartment 278*b* of the cover assembly interior 278, so that the container necks 147 extend through the openings 282 of the partition 280 and the openings 294 in the plate 292, as shown in the figure. The container caps 148 may then be fitted onto or received within the container cap receivers 296 of the movable body 290. The user may then grasp the handle 299 of the movable body 290 and carry the movable body 290 (jointly with the attached container caps 148). The user may insert the movable body 290 into the top interior compartment 278*a* of the cover assembly interior 278, and lower the movable body 290 and attached container caps 148 to a position in which the container caps 148 are fitted onto the container necks 147, as shown in FIG. 12. In some embodiments, such as the present embodiment, the movable body 290 may be shaped and sized such that, in the lowered position of the movable body 290, the plate 292 rests on the partition 280, said resting providing a stop which indicates the user that the container caps 148 have been correctly fitted onto the container necks 147 and are adequately closing the medication containers 142. The cover assembly 252 and connected (and closed) medication containers 142 may then be placed on the dispenser housing 102 (FIGS. 1-8) in order to dispense the medicines contained by the medication containers 142, as described heretofore with reference to FIGS. 1-8.

Figure 13:
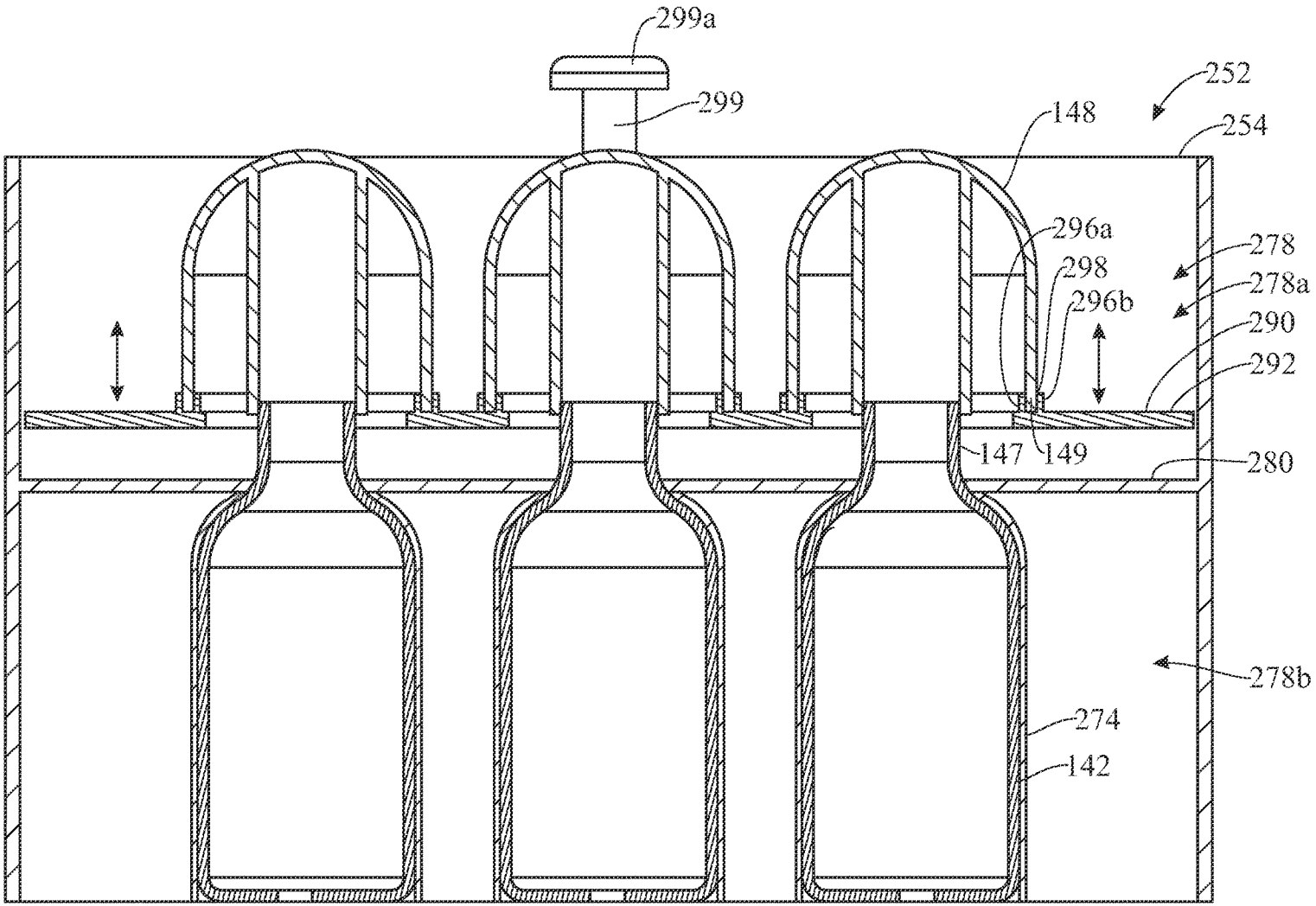
FIG. 13 presents a cross-sectional front elevation view similar to FIG. 12, with the movable body carrying the container caps shown in a raised position relative to the cover assembly frame and the medication containers.

Should the user wish to refill one or more medication containers 142, the user may simply grasp the handle 299 and pull the movable body 290 upward as shown in FIG. 13. Upward pulling of the movable body 290 causes the movable body 290 and container caps 148 to lift off of the container necks 147. Sufficient upward pulling eventually allows the user to remove the movable body 290 and container caps 148 and set them aside, and proceed to refill the medication container(s) 142 as needed. Once the medication containers 142 are ready for further use, the user may then proceed to insert and lower the movable body 290, and container caps 148 carried thereon, as described with reference to FIG. 12.

Thus, the cover assembly 252 of the present embodiment provides a convenient and easy to use mechanism for uncapping and recapping the medication containers and thereby facilitates refilling the containers as required by repeated or frequent use of the liquid medication dispenser.

Figure 14:
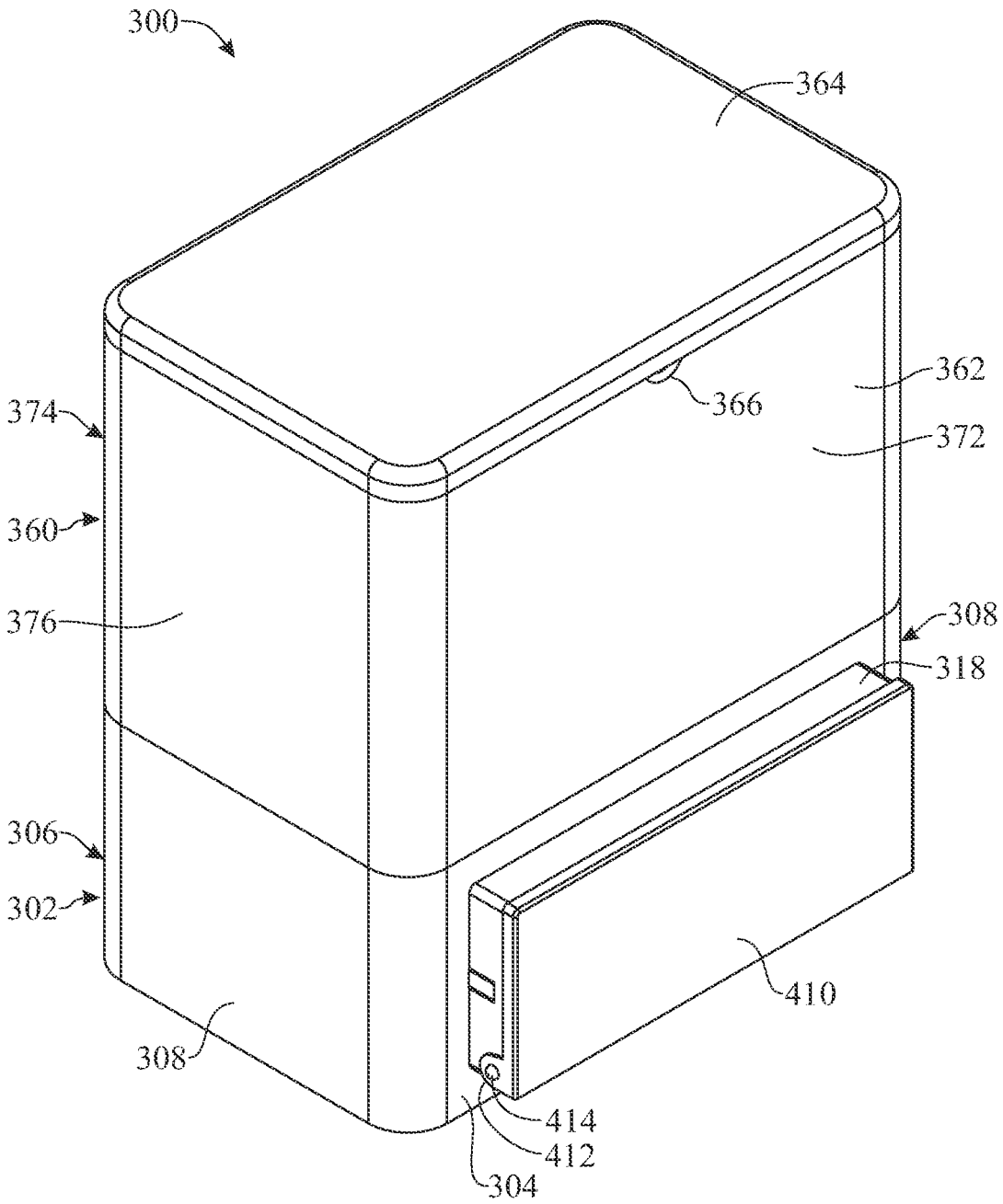
FIG. 14 presents a top front isometric view of a liquid medication dispenser in accordance with a third illustrative embodiment of the present invention, with a pivotable front cover shown in a closed position and the cover assembly shown placed on the dispenser housing.
Figure 15:
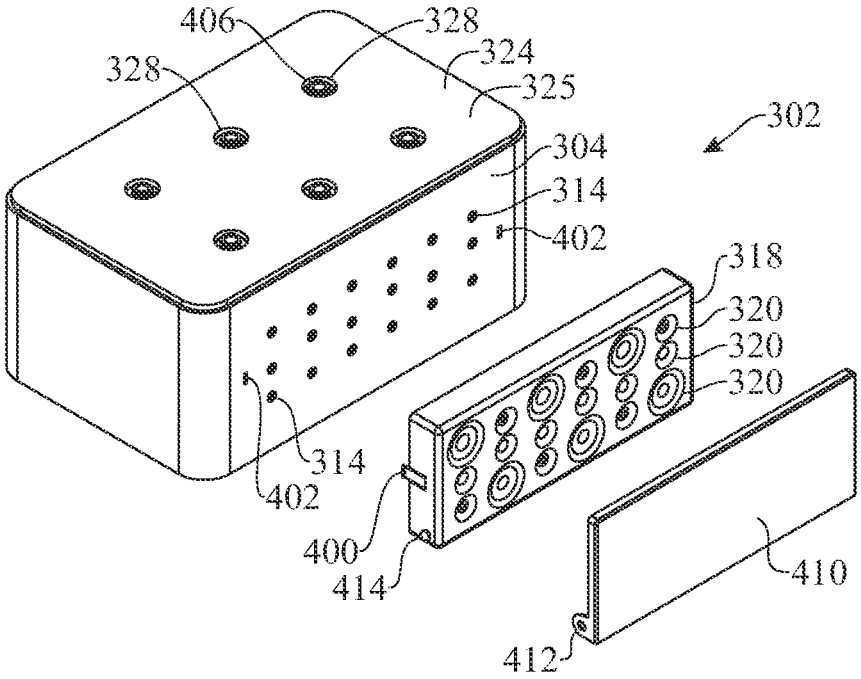
FIG. 15 presents an exploded, top front isometric view of the dispenser housing of the liquid medication dispenser of FIG. 14.
Figure 16:
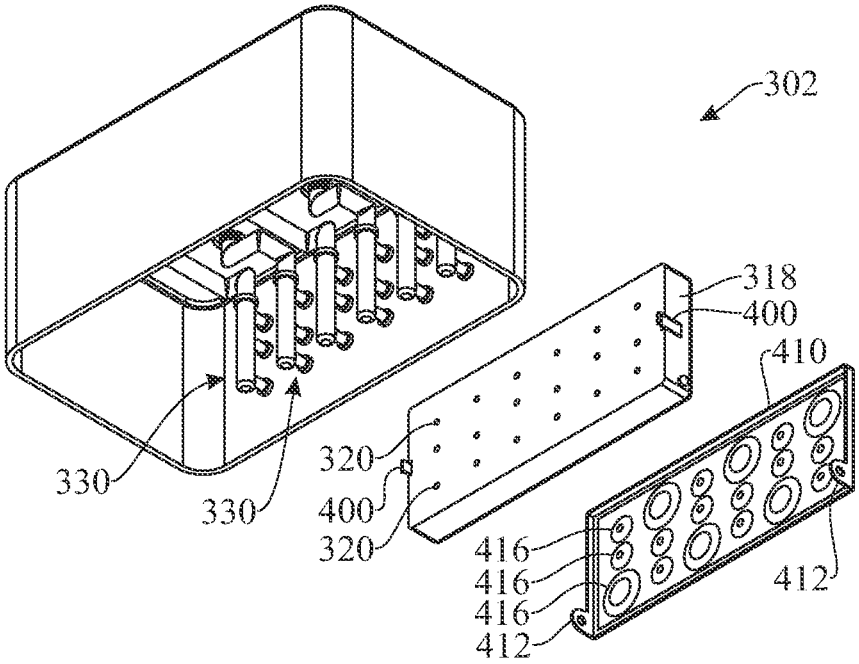
FIG. 16 presents an exploded, bottom rear isometric view of the dispenser housing of the liquid medication dispenser of FIG. 14, the view further revealing medication distribution assemblies housed inside the dispenser housing.
Figure 17:
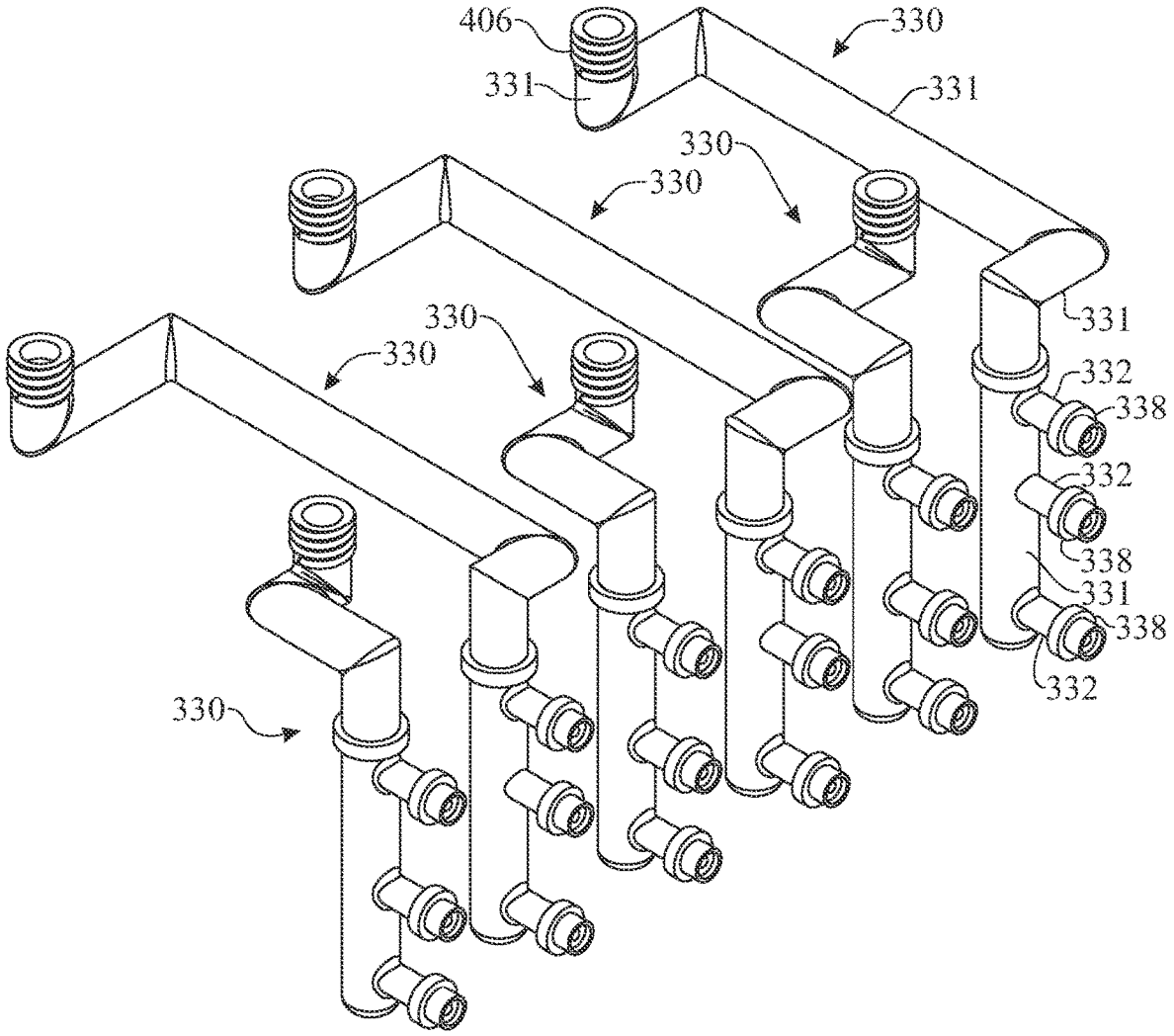
FIG. 17 presents an enlarged, top front isometric view of the medication distribution assemblies housed inside the dispenser housing of the liquid medication dispenser of FIG. 14.
Figure 18:
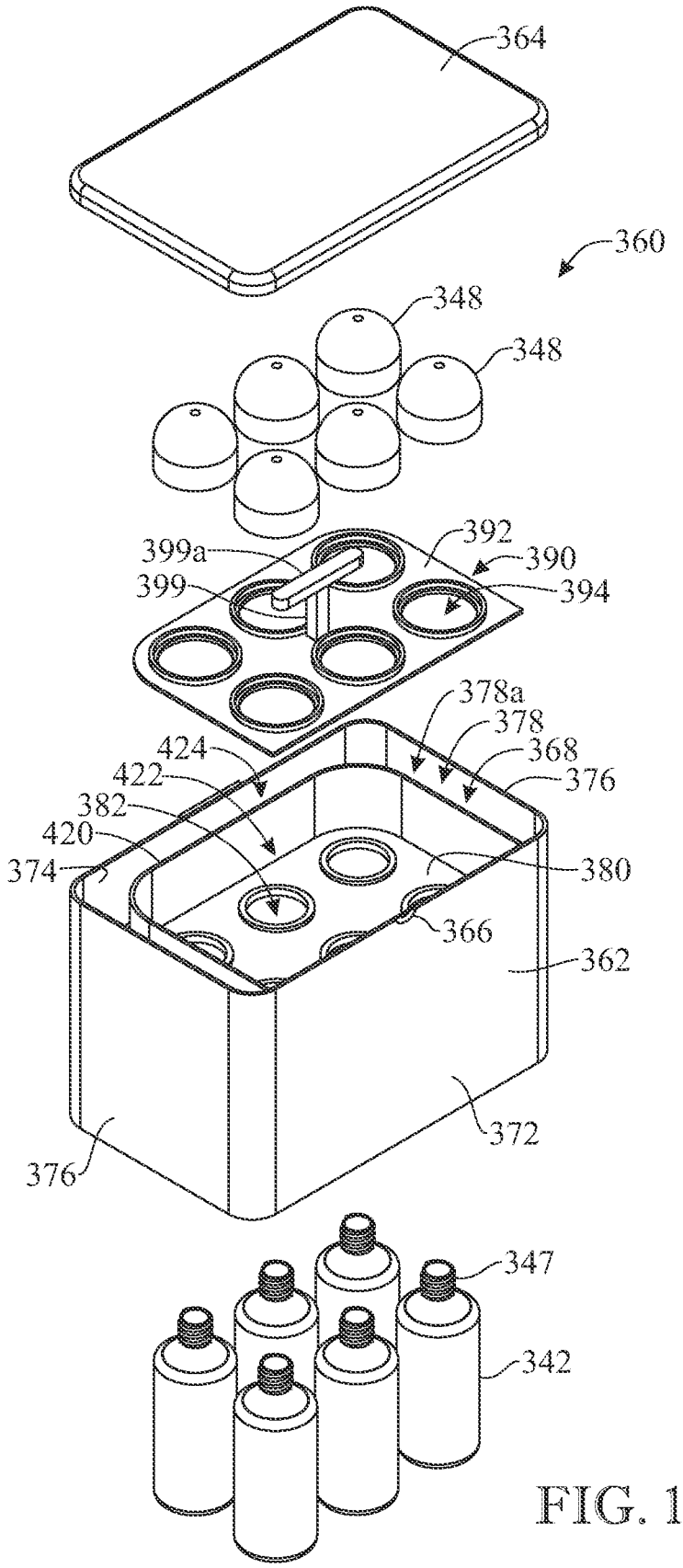
FIG. 18 presents a top, front isometric view of the cover assembly and movable body of the liquid medication dispenser of FIG. 14, together with a set of medication containers and respective container caps.

The illustrations of FIGS. 14-20 present a liquid medication dispenser 300 in accordance with a further embodiment of the invention. With reference initially to FIG. 14, similarly to the previous embodiments, the liquid medication dispenser 300 comprises a dispenser housing 302. The dispenser housing 302 includes a front wall 304, a rear wall 306, and side walls 308, defining a housing interior 310. As shown in FIG. 18, the dispenser housing 302 has an open bottom; however, alternative embodiments are contemplated in which the dispenser housing 302 may include a bottom wall closing the bottom of the dispenser housing 302. As shown in FIG. 15, a plurality of syringe openings 314 may extend through the dispenser housing 302, such as through the front wall 304, as shown. In some embodiments, one or more of the syringe openings 314 may be threaded. The syringe openings 314 can be provided in a selected pattern and spacing for purposes which will be hereinafter described.

Also similarly to the previous embodiments, and as further shown in FIGS. 14 and 15, a face plate 318 may be provided on the front wall 304. Similarly to aforementioned embodiments, the face plate 318 may be detachably attached to the front wall 304. For instance, the depicted face plate 318 is disconnectably attached to the front wall 304 by a clipping connection between a pair of elastically deformable arms 400 provided on the face plate 318 and configured to fit into corresponding openings 402 formed in the front wall 304 of the dispenser housing 302 and to elastically clip to the front wall 304.

The face plate 318 includes a plurality of sets of syringe barrel cavities 320, wherein each syringe barrel cavity 320 extends through the face place 318 and aligns with a respective syringe opening 314 in the front wall 304 of the dispenser housing 302. A housing lid or housing top wall 324 provided on the dispenser housing 302 to close the housing interior 310. In the present embodiment, the housing lid or housing top wall 324 forms a fixed or integral part of the dispenser housing 302, i.e. is non-removable; however, alternative embodiments are contemplated in which the housing lid or housing top wall 324 may be removable, similarly to embodiments heretofore described. The housing lid 324 includes a plurality of medication dispensing openings 328, for receiving a plurality of medication containers 342. In some embodiments, the housing lid 324 may include a corresponding plurality of medication container seats, similarly to the previous embodiment.

Figure 19:
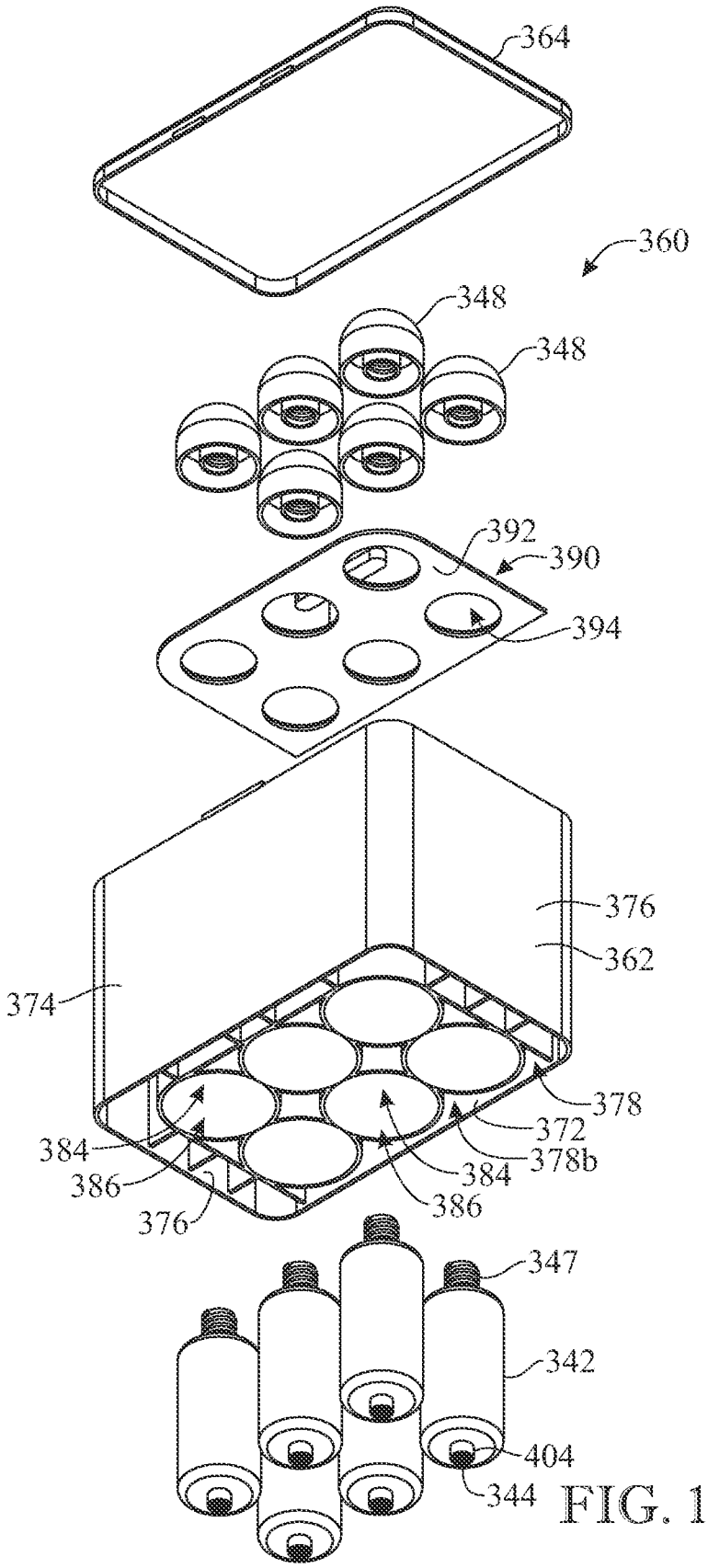
FIG. 19 presents a bottom, rear isometric view of the components of FIG. 18.

As shown in FIGS. 18 and 19, each medication container 342 includes a neck 347 and a container opening 344, arranged at a top and bottom of the medication container 342, respectively. The neck 347 may be threaded, as shown, allowing for disconnectable threading thereto of a respective container cap 348. In turn, the container opening 344 extends through the bottom of the medication container 342, and may be provided by a bottom neck 404, which may be threaded, as shown. The container neck 404 and container opening 344 may align or register with each corresponding medication dispensing opening 328.

As particularly illustrated in FIGS. 16 and 17, a plurality of medication distribution assemblies 330 may be disposed in the housing interior 310, wherein each medication distribution assembly provides fluid communication between a respective medication dispensing opening 328 at the top wall or housing lid 324 and a respective set of three, vertically-aligned syringe openings 314 on the front wall 304. As best shown in FIG. 17, each medication distribution assembly 330 may include an inlet conduit 331 which may extend from each corresponding medication dispensing opening 328 vertically downward and also horizontally, to direct fluid towards the front wall 304 of the dispenser housing 302. Each inlet conduit 331 comprises a thread 406 at a top end thereof, wherein the thread 406 is configured to thread to the threaded neck 404 of a respective medication container 342 and provide a disconnectable and preferably fluid-tight connection between the medication container 342 and the inlet conduit 331. As shown in FIG. 15, in some embodiments, the thread 406 of the inlet conduit 331 may extend at least partially through the medication dispenser opening 328 of the housing lid 324 to facilitate threading the neck 404 onto the thread 406. Alternatively or additionally, a resilient seal may be included, similarly to the resilient seal 134 described with reference to the embodiment of FIGS. 1-8. As further shown in FIG. 17, a plurality of outlet conduits 332 may extend from each inlet conduit 331, such as along a front-to-back direction of the dispenser housing 302 and frontward, towards the front wall 304 of the dispenser housing 302. The outlet conduit 332 may terminate in fluid communication with a corresponding syringe opening 314 in the front wall 304 of the dispenser housing 302. The outlet conduits 332 may be spaced apart with one another, in vertical alignment with one another, parallel to one another, and/or horizontal or sloped, as described with reference to previous embodiments. Similarly to previous embodiments, each outlet conduit 332 may include one or more sealing members at or near a front end thereof, the one or more sealing members configured to block fluid leaks between the front end of the outlet conduit 332 and a syringe connected to said front end. For instance, the one or more sealing members may include a compress and seal fitting 338 and/or a seal sleeve (not shown, but otherwise similar to the seal sleeve 136 described heretofore).

As shown in FIGS. 14-16, the liquid medication dispenser 300 may include a front cover 410, which may be operable to adopt a closed position (FIG. 14) and an open position (FIG. 20) relative to the dispenser housing 302. In the closed position, the front cover 410 covers the syringe barrel cavities 320 in the face plate 318. In the open position, instead, the front cover 410 exposes and allows access to the syringe barrel cavities 320. In some embodiments, such as the present embodiment, the front cover 410 may be pivotably connected to the face plate 318, such as by a hinged connection formed between two flanges 412 formed on opposite sides of the front cover 410 and two corresponding pins 414 provided on opposite sides of the face plate 318. Alternative embodiments are contemplated in which the front cover may instead be hinged to the dispenser housing 302, such as to the front wall 304 or side walls 308. In other non-limiting examples, the front cover may be slidable, removable, and/or secured by friction fitting, snap fitting, magnets or other fasteners. Furthermore, as shown in FIG. 16, a rear side of the front cover 410 may be provided with a plurality of protrusions 416, wherein each protrusion 416 is shaped and sized to match a respective syringe barrel cavity 320 of the face plate 318 that faces the protrusion 416. In some embodiments, the protrusions 416 may be elastic and configured to sealingly fit into the respective syringe barrel cavities 320 to seal the syringe barrel cavity 320 and block fluid from passing therethrough.

Figure 20:
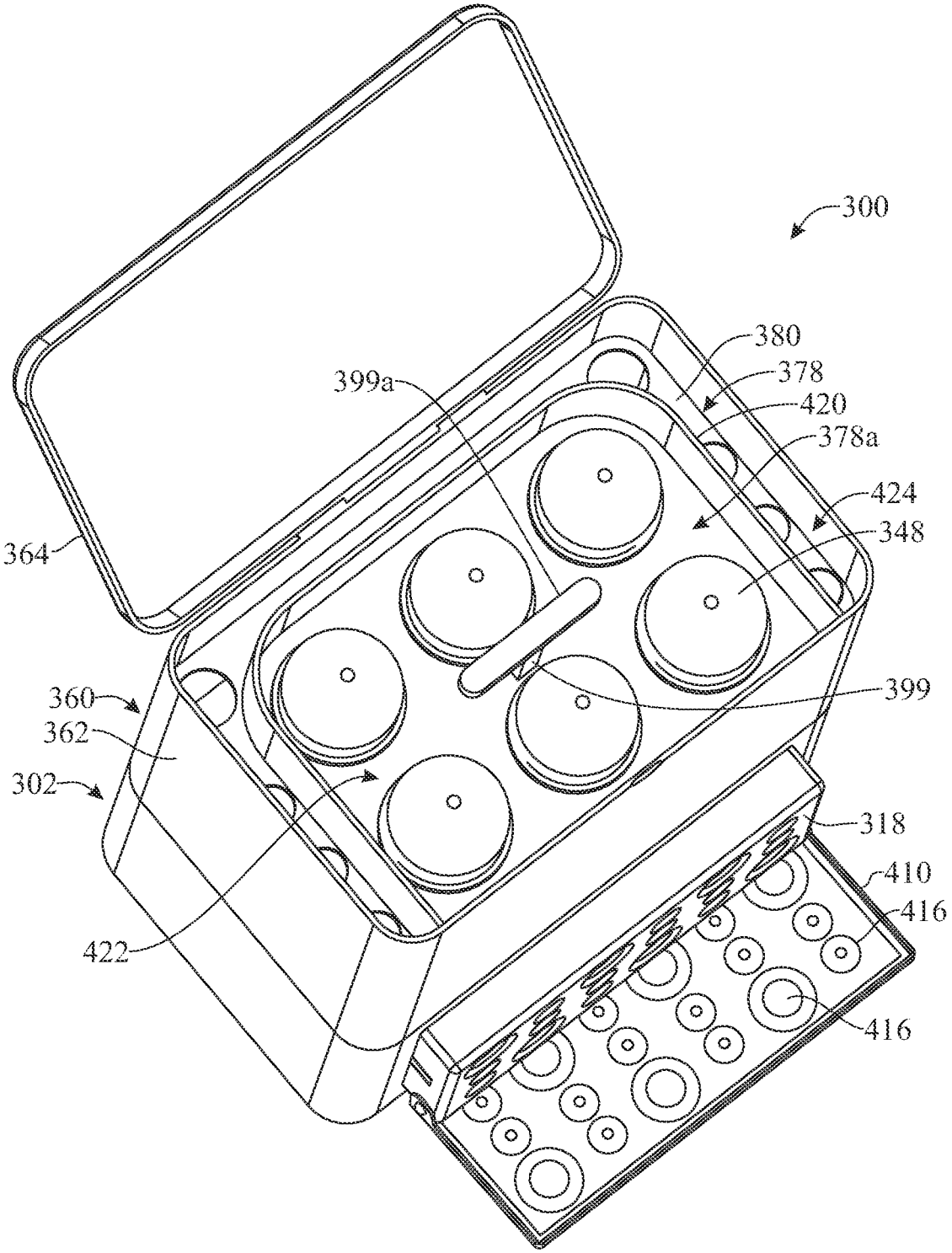
FIG. 20 presents a top perspective view of the liquid medication dispenser of FIG. 14, with the cover assembly lid and the front cover shown in an open position.

As illustrated in FIGS. 14, 18 and 19, in some embodiments, the liquid medication dispenser 300 may further include a removable cover assembly 360 that may be deployed on the dispenser housing 302 to cover or conceal the medication dispensing openings 328. The cover assembly 360 may include a cover assembly frame 362 and a cover assembly lid 364 detachably or movably engaging the cover assembly frame 362 such that the cover assembly lid 364 can be opened and closed. For instance, as shown in FIG. 20, the cover assembly lid 364 may be pivotably connected to the cover assembly frame 362. A finger notch 366 may be provided to facilitate selective removal or detachment of the cover assembly lid 364 from the cover assembly frame 362. In the present embodiment, the finger notch 366 is formed in the cover assembly frame 362. The cover assembly frame 362 may include a front wall 372, a rear wall 374 and pair of side walls 376 delimiting a cover assembly interior 378. As best shown in the exploded view of FIG. 18, at least one compartment 368 may be provided in the cover assembly interior 378 of the cover assembly frame 362, such as for storing one or more syringes or other applicable items.

As best shown in FIGS. 18 and 20, the cover assembly frame 362 further includes an inner wall or partition 380 arranged in an intermediate or central area of the cover assembly interior 378. The partition 380 divides the cover assembly interior 378 into a top interior compartment **378*a* and a bottom interior compartment 378*b* and includes openings 382 extending through the partition 380 and communicating the top and bottom interior compartments 378*a* and 378*b*. As shown in FIG. 19, the cover assembly frame 362 further includes a plurality of container receptacles 384, arranged within the bottom interior compartment 378*b* of the cover assembly interior 378. Each container receptacle 384 extends downward from the partition 380, and more specifically, from a respective opening 382 of the plurality of openings 382 of the partition 380, and ends in a respective bottom opening 386. Each container receptacle 384 is configured to receive a respective one of the medication containers 342 through the bottom opening 386 such that the top neck 347 of the medication container 342 extends through the opening 382 of the partition 380, and is threadable to a respective container cap 348**.

Similarly to the embodiment of FIGS. 9-13, the cover assembly 360 of the present embodiment further includes a movable support or body 390 movably received within the cover assembly interior 378. The movable body 390 may include a base or plate 392, which may be rectangular in some embodiments. A plurality of openings 394 are formed through the plate 392, wherein each opening 394 is configured to align with a respective opening 382 of the partition 380, to enable the corresponding bottle neck 347 to also extend through the opening 394 when the movable body 390 is in a lowered position. The plate 392 may include a plurality of container cap receivers 396 configured to receive the container caps 348 and prevent transverse movement of the container caps 348 relative to the plate 392. The container cap receivers 396 may be constructed similarly or the same as the container cap receivers 196 described with reference to FIGS. 9-13, i.e. may include, for instance, two concentric ridges defining an annular gap therebetween for receiving a bottom end of the container cap 348. The movable body 390 further includes a handle 399 extending upward from the plate 392. The handle 399 may end, for instance, in a T-shaped head **399*a*, as shown. A user may grasp the T-shaped head 399*a* and exert a pulling or pushing force thereon to raise or lower the movable body 390**, respectively.

In some embodiments, such as the present embodiment, one or more sidewalls 420 can extend upward from the partition 380 and divide the top interior compartment **378*a* in two or more parts or sub-compartments. For instance, in the present embodiment, a C-shaped sidewall 420 extends upward from the partition 380 and divides the top interior compartment 378*a* into a first area or sub-compartment 422 and a second area or sub-compartment 424. The movable body 390 is movably received within the first sub-compartment 422, while the second sub-compartment 424 provides the aforementioned compartment 368 for storing one or mode syringes or other items. In this manner, operation of the movable body 390 is independent of the storage compartment 348, allowing to simultaneously operate the movable body 390 while holding items in the compartment 348. In some embodiments, the second sub-compartment 424 may be divided into more than one storage compartment 368, such as by including a different number of sidewalls extending from the partition 380**.

An example of operation of the liquid medication dispenser 300 will now be described. Initially, the medication containers 342 may be connected to the liquid medication dispenser 300 by threaded the bottom neck 404 of each medication container 342 to a corresponding thread 406 accessible via a corresponding medication dispensing opening 328 in the housing top wall or housing lid 324. Next, the container caps 348 may be unthreaded from the medication containers 342.

The cover assembly 360 may then be fitted over the medication containers 342 such that the medication containers 342 are inserted through the bottom openings 386 and into the corresponding container receptacles 384 formed in the bottom interior compartment **378*b* of the cover assembly interior 378, and the container necks 347 extend through the openings 382 of the partition 380. In turn, the container caps 348 may be fitted onto or received within the container cap receivers 396 of the movable body 390. The user may then grasp the handle 399 of the movable body 390, carry the movable body 390 (jointly with the attached container caps 348), insert the movable body 390 into the first sub-compartment 422 of the top interior compartment 378*a* of the cover assembly interior 378, and lower the movable body 390 and attached container caps 348 to a position in which the container caps 348 are fitted onto the container necks 347. The user may then optionally rotate the container caps 348 to thread onto the container necks 347. The user may then open the front cover 410 and connect one or more syringes (which may have been stored until then in the compartment 368, i.e. the second sub-compartment 424) to one or more syringe barrel cavities 320 to establish fluid communication between each syringe and a corresponding medication container 342** in order to load the syringe with medication.

Should the user wish to refill one or more medication containers 342, the user may unthread each container cap 348 from the corresponding top neck 347 (if previously threaded), and then grasp the handle 399 and pull the movable body 390 upward. Upward pulling of the movable body 390 causes the movable body 390 and container caps 348 to lift off of the container necks 347. Sufficient upward pulling eventually allows the user to remove the movable body 390 and container caps 348 from the first sub-compartment 422 and set them aside, and proceed to refill the medication container(s) 342 as needed.

Alternative embodiments are contemplated without departing from the scope of the present disclosure. For instance, the liquid medication dispenser may a number of medication distribution assemblies other than six, such that the liquid medication dispenser may receive a number of medication containers other than six. For example, the liquid medication dispenser may include a single medication distribution assembly configured to establish fluid communication between a single medication distribution opening and a set of two or more (e.g., three) syringe openings and corresponding syringe barrel cavities, preferably of different sizes (corresponding to different syringe sizes).

In summary, the present invention provides a liquid medication dispenser that will contribute to simplify a consumer, patient or caregiver's everyday life. The medication dispenser stores liquid medication (via medication containers) and enables the user to draw medication directly from the medicine containers through a face plate, and directly dispense the medication into G tubes, orally, etc. The invention allows to avoid the time-consuming gathering of bottles, one by one opening of bottles, drawing medicine from each bottle one at a time, re-closing the medicine bottles, and then administering the medications (orally or through G tube). This may save significant amounts of time for many users who need to frequently take medications. For example, it must be noted that most special-need individuals or sick individuals must consume medications up to 30 times a day. The present invention relieves such individuals or their caregivers from having to open and close medication bottles that many times a day. Furthermore, the invention is easy to use and relieves the tiring and stressful routine of dispensing liquid medication.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

What is claimed is:

1. A liquid medication dispenser which is suitable for loading liquid medication from a plurality of medication containers into different syringes, comprising:

a dispenser housing having a housing interior;

a plurality of medication dispensing openings formed through a top wall of the dispenser housing;

a plurality of sets of syringe openings formed through the dispenser housing, each set of syringe openings comprising two or more different-sized syringe openings;

a plurality of medication distribution assemblies arranged in the housing interior, wherein each medication distribution assembly provides fluid communication between a respective medication dispensing opening of the plurality of medication dispensing openings and a respective set of syringe openings of the plurality of sets of syringe openings;

a cover assembly mountable on the dispenser housing, the cover assembly comprising:

a cover assembly frame defining a cover assembly interior configured to house a plurality of medication containers in an upright position with each medication container of the plurality of medication containers arranged over a respective medication dispensing opening of the plurality of medication dispensing openings, and a partition arranged in the cover assembly interior, the partition comprising a plurality of partition openings formed through the partition and configured to receive a top opening of a respective medication container of a plurality of medication containers housed in the cover assembly interior; and a movable body insertable into and movable along a first area of the cover assembly interior, the movable body comprising a plate having a plurality of plate openings configured to align with the plurality of partition openings, the plate further comprising a plurality of container cap receivers, each container cap receiver arranged at a respective plate opening of the plurality of plate openings and configured to carry a respective container cap and prevent a transverse movement of the respective container cap relative to the respective plate opening; wherein the movable body is selectively movable between:

a first position, in which the plate of the movable body is arranged within the cover assembly interior and each plate opening of the plurality of plate openings is adjacent to and aligned with a respective partition opening of the plurality of partition openings, and a second position, in which the plate of the movable body is moved away from the plurality of partition openings allowing access to the partition openings.

2. The liquid medication dispenser of claim 1, wherein the dispenser housing further comprises a plurality of medication container seats in the housing, wherein each medication container seat is configured to receive a respective medication container, and further wherein a respective medication dispensing opening of the plurality of medication dispensing openings is located at said each medication container seat.

3. The liquid medication dispenser of claim 2, wherein said each medication container seat is recessed into an outer surface of the dispenser housing.

4. The liquid medication dispenser of claim 1, wherein the top wall of the dispenser housing is movable between a closed position enclosing the housing interior and an open position allowing access to the housing interior.

5. The liquid medication dispenser of claim 1, wherein the cover assembly comprises at least one storage compartment.

6. The liquid medication dispenser of claim 1, wherein the cover assembly comprises a plurality of container receptacles arranged in the cover assembly interior, wherein each container receptacle is configured to contain a respective medication container in an upright position, wherein each container receptacle is arranged in vertical alignment with a respective medication dispensing opening of the plurality of medication dispensing openings when the cover assembly is mounted on the dispenser housing.

7. The liquid medication dispenser of claim 1, wherein the cover assembly comprises a plurality of container receptacles arranged in the cover assembly interior and beneath the partition, wherein each container receptacle is configured to contain a respective medication container in an upright position, wherein each container receptacle is arranged in vertical alignment with a respective medication dispensing opening of the plurality of medication dispensing openings when the cover assembly is mounted on the dispenser housing, and further wherein each partition opening faces a respective container receptacle of the plurality of container receptacles.

8. The liquid medication dispenser of claim 1, wherein the movable body comprises a handle extending from the plate.

9. The liquid medication dispenser of claim 1, wherein the cover assembly comprises at least one storage compartment in a second area of the cover assembly interior separated from the first area.

10. The liquid medication dispenser of claim 1, wherein the dispenser housing further comprises a face plate mountable on a front wall of the dispenser housing, wherein each syringe opening of the two or more different-sized syringe openings is formed by a respective first opening formed in the front wall of the dispenser housing and a respective second opening formed in the face plate, the respective second opening aligned with the respective first opening when the face plate is mounted on the front wall.

11. The liquid medication dispenser of claim 10, wherein the face plate is detachably mountable on the front wall, and further wherein the two or more second openings of the two or more different-sized syringe openings comprised in said each set of syringe openings are sized differently to each other.

12. The liquid medication dispenser of claim 1, wherein each medication distribution assembly of the plurality of medication distribution assemblies comprises an inlet conduit and two or more outlet conduits, wherein the inlet conduit extends from the respective medication dispensing opening and further wherein each outlet conduit of the two or more outlet conduits extends from the inlet conduit to a respective syringe opening of the respective set of syringe openings.

13. The liquid medication dispenser of claim 12, wherein the two or more syringe openings of the respective set of syringe openings are arranged in vertical alignment, and further wherein the two or more outlet conduits of each medication distribution assembly are arranged in vertical alignment.

14. The liquid medication dispenser of claim 12, wherein the two or more syringe openings of the respective set of syringe openings are arranged in spaced-apart relationship, and further wherein the two or more outlet conduits of each medication distribution assembly are arranged in spaced-apart relationship.

15. The liquid medication dispenser of claim 12, wherein the plurality of sets of syringe openings are formed through a front wall of the dispenser housing, and further wherein the two or more outlet conduits of each medication distribution assembly are arranged in a front-to-back direction of the dispenser housing.

* * * * *